US008147056B2

(12) United States Patent
Sugimoto et al.

(10) Patent No.: US 8,147,056 B2
(45) Date of Patent: Apr. 3, 2012

(54) INK-JET RECORDING APPARATUS PREVENTING RECORDING SURFACE OF RECORDING MEDIUM AND PAPER DISCHARGE ROLLER FROM CONTAMINATION

(75) Inventors: Aya Sugimoto, Sendai (JP); Hidehiko Kanda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 661 days.

(21) Appl. No.: 11/236,029

(22) Filed: Sep. 27, 2005

(65) Prior Publication Data

US 2006/0071995 A1 Apr. 6, 2006

(30) Foreign Application Priority Data

Oct. 1, 2004 (JP) ..... 2004-290385

(51) Int. Cl.
*B41J 2/01* (2006.01)

(52) U.S. Cl. ..... 347/104; 347/101; 347/16

(58) Field of Classification Search ..... 347/104, 347/101, 16, 40, 41
See application file for complete search history.

(56) References Cited

U.S. PATENT DOCUMENTS 5,638,098 A * 6/1997 Iwata et al. ..... 347/9
6,007,194 A * 12/1999 Yokoyama et al. ..... 347/104
6,695,432 B2 * 2/2004 Kanda ..... 347/41
6,705,717 B1 * 3/2004 Fujita et al. ..... 347/106
7,360,857 B2 * 4/2008 Koshikawa ..... 347/16

FOREIGN PATENT DOCUMENTS

JP 06-198865 A 7/1994
JP 08-002063 A 1/1996
JP 08-290557 A 11/1996
JP H09-094944 4/1997
JP 2002-059538 2/2002
JP 2002-361854 12/2002

* cited by examiner

*Primary Examiner* — Matthew Luu
*Assistant Examiner* — Henok Legesse
(74) *Attorney, Agent, or Firm* — Canon USA Inc IP Division

(57) ABSTRACT

With the width in the main scanning direction of the image region of which the recording width in the main scanning direction is the shortest of all of the image regions to be recorded on the recording surface of the recording medium as X1 in the main scanning direction, the width obtained by subtracting the width of the ink discharge orifice from the width between the ink discharge orifice closet to the discharge side, of the ink discharge orifices employed for recording of an image region and the roller as Y1 in the sub scanning direction, and the period necessary for completing another image region defined by the width X1 and the width Y1 as T1, the sub scanning of the recording medium is controlled such that the one image region comes into contact with the roller after the period T1 from the point of completion thereof.

8 Claims, 24 Drawing Sheets

DURING 100% RECORING DUTY

| PERIOD FROM RECORDING TO PASSING THROUGH PAPER DISCHARGE ROLLER [SEC.] | CONTAMINATION OF ROLLER / TRANSFER OF CONTAMINATION FROM ROLLER TO RECORDING MEDIUM |
|---|---|
| 0.4 | × |
| 3.6 | × |
| 7.6 | △ |
| 10.6 | ○ |
| 13.6 | ○ |

FIG. 13

| | RECORDING MODE | |
|---|---|---|
| | FIRST RECORDING MODE | SECOND RECORDING MODE |
| QUIESCENT PERIOD T2 [SEC.] | 10 | 2.4 |

DURING 75% RECORING DUTY

| PERIOD FROM RECORDING TO PASSING THROUGH PAPER DISCHARGE ROLLER [SEC.] | CONTAMINATION OF ROLLER / TRANSFER OF CONTAMINATION FROM ROLLER TO RECORDING MEDIUM |
|---|---|
| 0.4 | × |
| 3.6 | △ |
| 7.6 | ○ |
| 10.6 | ○ |
| 13.6 | ○ |

FIG. 19

DURING 50% RECORING DUTY

| PERIOD FROM RECORDING TO PASSING THROUGH PAPER DISCHARGE ROLLER [SEC.] | CONTAMINATION OF ROLLER / TRANSFER OF CONTAMINATION FROM ROLLER TO RECORDING MEDIUM |
|---|---|
| 0.4 | × |
| 3.6 | ○ |
| 7.6 | ○ |
| 10.6 | ○ |
| 13.6 | ○ |

FIG. 20

| DOT COUNT LEVEL | NUMBER OF DOTS |
|---|---|
| 0 | 32768(50%)>D |
| 1 | 49152(75%)>D≧32768(50%) |
| 2 | D≧49152(75%) |

| DOT COUNT LEVEL | PERIOD FROM RECORDING TO PASSING THROUGH PAPER DISCHARGE ROLLER [SEC.] |
|---|---|
| 0 | 3.6 |
| 1 | 7.6 |
| 2 | 10.6 |

FIG. 27

| | RECORDING MODE | |
|---|---|---|
| | FIRST RECORDING MODE | SECOND RECORDING MODE |
| QUIESCENT PERIOD T1 [SEC.] | 10.6 | 7.6 |
| QUIESCENT PERIOD T3 [SEC.] | 7.6 | 3.6 |

INK-JET RECORDING APPARATUS PREVENTING RECORDING SURFACE OF RECORDING MEDIUM AND PAPER DISCHARGE ROLLER FROM CONTAMINATION

BACKGROUND OF THE INVENTION

1. Field of the Invention

The present invention relates to a recording apparatus, which performs recording while main-scanning (horizontally scanning) a recording head in the main scanning direction, and while sub-scanning (vertically scanning) a recording medium relatively different from the main scanning direction, and the method and program thereof.

2. Description of the Related Art

As for recording apparatuses, apparatuses having functions such as a printer, photocopier, facsimile, and the like have been known. Also, recording apparatuses have been employed as output equipment of terminals, such as multi-function-type electronic equipment including computers, word-processors, or workstation or the like. Such a recording apparatus is configured so as to record an image (including characters etc.) on a recorded medium such as a recording sheet, a plastic thin plate, or the like based on image information including character information.

This recording apparatus is classified into the ink-jet type, wire dot type, thermal type, laser beam type, or the like depending on the recording method thereof. Of these recording methods, an ink-jet-type recording apparatus (ink-jet recording apparatus) is an apparatus which performs recording by discharging ink onto a recording medium from recording means (recording head). The ink-jet method has more excellent features than other recording methods in that high definition is readily realized, and moreover, this method excels in calmness at a high speed, and also excels in cheapness.

Generally, a common ink-jet recording apparatus employs a recording head in which a plurality of ink discharge orifices and liquid channels serving as an ink discharge unit are integrated as a recording head made up of a plurality of recording devices being integrated and arrayed for improved recording speed, and further, includes a plurality of said recording heads as for color-handling.

Now, description will be made regarding the configuration of a common ink-jet recording apparatus with reference to FIG. 1.

FIG. 1 particularly illustrates the configuration of a printer unit at the time of recording on a recording sheet surface serving as a recording medium using a recording head.

In FIG. 1, reference numeral 101 denotes ink cartridges. These are made up of ink tanks into which four-colored ink, i.e., black, cyan, magenta, and yellow ink are filled respectively, and recording heads 102 corresponding to the respective colors. It is FIG. 2 that a scene of ink discharge orifices arrayed on the recording heads 102 is illustrated from the Z direction, and reference numeral 201 denotes a plurality of ink discharge orifices arrayed on the recording heads 102.

Returning to FIG. 1 again, reference numeral 103 denotes a paper feed roller, which rotates in the direction of the arrow in the drawing while suppressing a recording medium P along with a spur 104, and conveys the recording medium P in the Y direction (sub scanning direction) as needed. Also, reference numeral 105 denotes a paper supply roller, which supplies the recording medium P, and also serves as a role for suppressing the recording medium P as well as the paper feed roller 103 and the spur 104.

Reference numeral 106 denotes a carriage, which supports the four ink cartridges 101, and moves these in accordance with recording. This is configured so as to stand by at a home position h illustrated with a dotted line in the drawing when recording is not performed, or when the recovery work of the recording heads 102 or the like is performed.

Upon a recording start command being received, the carriage 106 disposed at the position (home position h) in the drawing before starting recording performs recording by discharging a recording material (ink) on the recording medium P from the plurality of ink discharge orifices 201 on the recording heads 102 while moving in the X direction (main scanning direction). Upon recording for forming an image being completed up to the end portion of the recording medium P disposed on the opposite side of the home position h, the carriage 106 returns to the original home position h, and performs simplex recording for repeating recording in the X direction again. Also, in the event of performing high-speed printing, the carriage 106 performs two-way recording for performing recording from both of the outward direction in the X direction and the homeward direction in the −X direction.

Also, a period for permeating and fixing of ink as to the recording medium P is secured by providing an intermission period during recording in each main scanning direction, thereby preventing irregularities in concentration, irregularities in color, bleeding between colors, and contamination of the recording medium due to contact between the recording heads and the recording medium. For example, with Japanese Patent Laid-Open No. 2002-361854, the configuration wherein an intermission period is provided during each main scanning alone to prevent contamination of a recording medium due to contact between a recording head and the recording medium has been disclosed.

With the above ink-jet recording apparatus, in particular, with an ink-jet recording apparatus which can record a recording medium up to photograph-dedicated A6 size alone, image quality improves by using small droplets or low-concentration ink. Here, in order to obtain further high quality images, in particular, in the event of performing paper feeding using the roller on the paper discharging side alone, improvement in precision of the rear end portion to be recorded has been required.

With paper feeding by employing a conventional spur, the rear end of a recording medium is supported by the spur alone to convey the recording medium, so that the positioning precision of the recording medium deteriorates, and consequently, the image quality of an image to be recorded on the recording medium deteriorates. To this end, instead of paper feeding by employing a conventional spur, a method for employing a roller has been employed.

However, in the event of a state in which fixing of ink as to the recording medium is insufficient, both a recording image and the roller are contaminated by the recording surface of the recording medium contacting the roller, and the recording image on the recording medium being transferred to the roller. Also, once ink adheres on the roller to contaminate the roller, immediately following which ink is transferred on a recording image from the roller, so that the recording image is contaminated by unnecessary ink. However, contamination of an image and the roller cannot be prevented at the time of discharging paper, or at the time of canceling printing by simply providing an intermission period during each conventional main scanning.

SUMMARY OF THE INVENTION

The present invention provides a recording apparatus which solves the above problems, and the method and program thereof. That is to say, the present invention provides a recording apparatus which prevents contamination of a recording image and the paper discharge roller due to ink by the recording image on a recording medium contacting the paper discharge roller, even in the event of fixing of ink as to the recording medium is insufficient, and the method and program thereof.

The present invention provides a recording apparatus with a configuration to solve the above problems. According to a first aspect of the present invention, a recording apparatus for performing recording while main-scanning (horizontally scanning) a recording head in the main scanning direction, and while sub-scanning (vertically scanning) a recording medium relatively in the sub scanning direction different from the main scanning direction, comprises: the recording head having a plurality of ink discharge orifices arrayed in the sub scanning direction; a roller, which is disposed between the discharge side in which the recording medium supplied from the supply opening of the recording apparatus is discharged to the outside from a discharge opening, and the recording head, for conveying the recording medium while coming into contact with the recording surface of the recording medium; and control means for controlling the main scanning of the recording head and the sub scanning of the recording medium; wherein with recording actions for completing an image region W1 where the recording surface of the recording medium is recorded by discharging ink from the recording head, upon assuming that the width in the main scanning direction of the image region of which the recording width in the main scanning direction is the shortest of all of the image regions to be recorded on the recording surface of the recording medium is X1 in the main scanning direction, the width obtained by subtracting the width of the ink discharge orifice from the width between the ink discharge orifice closet to the discharge side, of the ink discharge orifices employed for recording of the image region W1 and the roller is Y1 in the sub scanning direction, and the period necessary for completing an image region W2 defined by the width X1 and the width Y1 is T1, the control means control the sub scanning of the recording medium such that the image region W1 comes into contact with the roller after the elapsing of the period T1 from the point of completion of the image region W1, and also perform control so as to repeat at least one of actions, either the main scanning of the recording head or the sub scanning of the recording medium up to the elapsing of a period of (1/3)×T1 or more from completion of the image region W1 in the event that there is no recording data to be recorded in the region closer to the supply side of the recording medium than the image region W1.

According to a second aspect of the present invention, a method for controlling a recording apparatus which comprises a recording head having a plurality of ink discharge orifices arrayed in the sub scanning direction different from the main scanning direction, and a roller, which is disposed between the discharge side in which a recording medium supplied from a supply opening is discharged to the outside from a discharge opening, and the recording head, for conveying the recording medium while coming into contact with the recording surface of the recording medium, and performs recording while main-scanning (horizontally scanning) the recording head in the main scanning direction, and while sub-scanning (vertically scanning) the recording medium relatively in the sub scanning direction, comprises: a receiving process for receiving recording data for performing recording by the recording head; and a control process for controlling the main scanning of the recording head and the sub scanning of the recording medium based on the received recording data in the receiving process; wherein with recording actions for completing an image region W1 where the recording surface of the recording medium is recorded by discharging ink from the recording head, upon assuming that the width in the main scanning direction of the image region of which the recording width in the main scanning direction is the shortest of all of the image regions to be recorded on the recording surface of the recording medium is X1 in the main scanning direction, the width obtained by subtracting the width of the ink discharge orifice from the width between the ink discharge orifice closet to the discharge side, of the ink discharge orifices employed for recording of the image region W1 and the roller is Y1 in the sub scanning direction, and the period necessary for completing an image region W2 defined by the width X1 and the width Y1 is T1, the control process controls the sub scanning of the recording medium such that the image region W1 comes into contact with the roller after the elapsing of the period T1 from the point of completion of the image region W1, and also performs control so as to repeat at least one of actions, either the main scanning of the recording head or the sub scanning of the recording medium up to the elapsing of a period of (1/3)×T1 or more from completion of the image region W1 in the event that there is no recording data to be recorded in the region closer to the supply side of the recording medium than the image region W1.

According to a third aspect of the present invention, a program for realizing control of a recording apparatus which comprises a recording head having a plurality of ink discharge orifices arrayed in the sub scanning direction different from the main scanning direction, and a roller, which is disposed between the discharge side in which a recording medium supplied from a supply opening is discharged to the outside from a discharge opening, and the recording head, for conveying the recording medium while coming into contact with the recording surface of the recording medium, and performs recording while main-scanning (horizontally scanning) the recording head in the main scanning direction, and while sub-scanning (vertically scanning) the recording medium relatively in the sub scanning direction, comprises: a program code in a receiving process for receiving recording data for performing recording by the recording head; and a program code in a control process for controlling the main scanning of the recording head and the sub scanning of the recording medium based on the received recording data in the receiving process; wherein with recording actions for completing an image region W1 where the recording surface of the recording medium is recorded by discharging ink from the recording head, upon assuming that the width in the main scanning direction of the image region of which the recording width in the main scanning direction is the shortest of all of the image regions to be recorded on the recording surface of the recording medium is X1 in the main scanning direction, the width obtained by subtracting the width of the ink discharge orifice from the width between the ink discharge orifice closet to the discharge side, of the ink discharge orifices employed for recording of the image region W1 and the roller is Y1 in the sub scanning direction, and the period necessary for completing an image region W2 defined by the width X1 and the width Y1 is T1, the control process controls the sub scanning of the recording medium such that the image region W1 comes into contact with the roller after the elapsing of the period T1 from the point of completion of the image region W1, and also performs control so as to repeat at least one of actions, either the main scanning of the recording head or the sub scanning of the recording medium up to the elapsing of a period of (1/3)×T1 or more from completion of the image region W1 in the event that there is no recording data to be recorded in the region closer to the supply side of the recording medium than the image region W1.

The present invention can prevent a recorded image and the paper discharge roller from contamination caused by the recording image on a recording medium rubbing against the paper discharge roller, even in the event of insufficient fixing of ink as to the recording medium.

Further features of the present invention will become apparent from the following description of exemplary embodiments with reference to the attached drawings.

BRIEF DESCRIPTION OF THE DRAWINGS

FIG. 13 is a diagram illustrating an intermission period T2 set according to a recording mode described in the second example of the present invention.

FIG. 19 is a diagram illustrating evaluation results of a period up to passing through a paper discharge roller, and contamination levels of the paper discharge roller and a recording surface described in the third example of the present invention.

FIG. 20 is a diagram describing the classification of dot count levels according to the number of dots with the third example of the present invention.

FIG. 27 is a diagram illustrating intermission periods T1 and T3 set according to the recording mode described in a sixth example of the present invention.

DESCRIPTION OF THE EMBODIMENTS

Detailed description will be made below regarding an embodiment of the present invention with reference to the drawings.

Note that with the present specification, the term "printing" means not only to form intentional information such as characters, figures, and the like, but also to form images, designs, patterns, and the like on a recording medium. Note that with the following description, this is sometimes referred to as "recording". Also, an image to be printed is not restricted to whether or not an image is actualized such that a human can sense using visual sense. Further, "printing" is also applied to a case wherein working of a medium is performed.

Also, the term "recording medium" means an article which can receive ink discharged by the recording head, such as cloth, a plastic film, a metal plate, or the like, as well as paper generally employed by a common recording apparatus.

Further, the term "ink" is to be widely interpreted as with the above "printing", and means liquid to be employed for formation of images, designs, patterns, and the like, or processing of a recording medium by applying on the recording medium.

First, description will be made regarding the control configuration of an ink-jet recording apparatus according to each example of the present invention with reference to FIG. 3.

Figure 1:
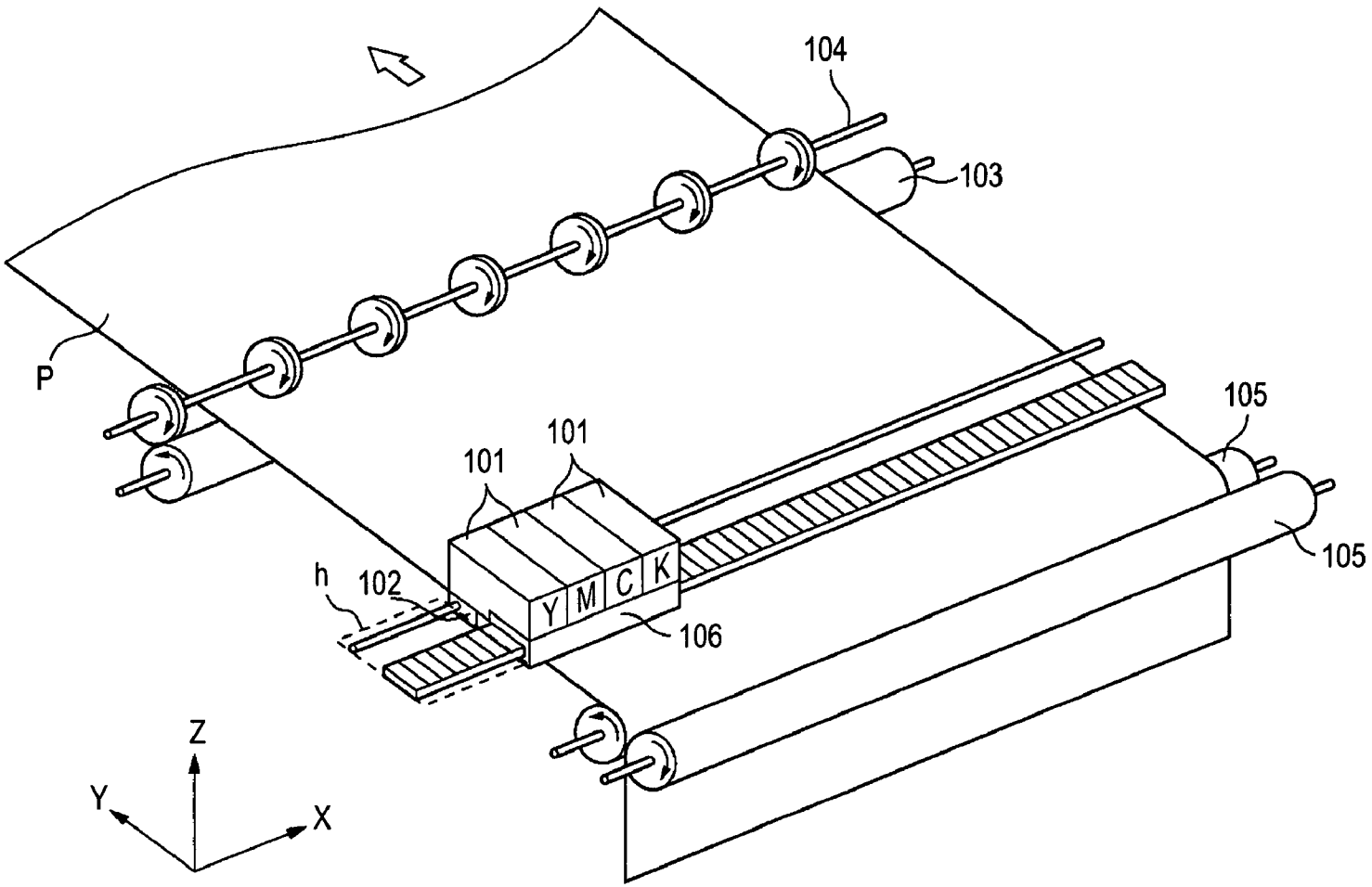
FIG. 1 is a schematic explanatory diagram of an ink-jet recording apparatus to which the present invention can be applied.
Figure 3:
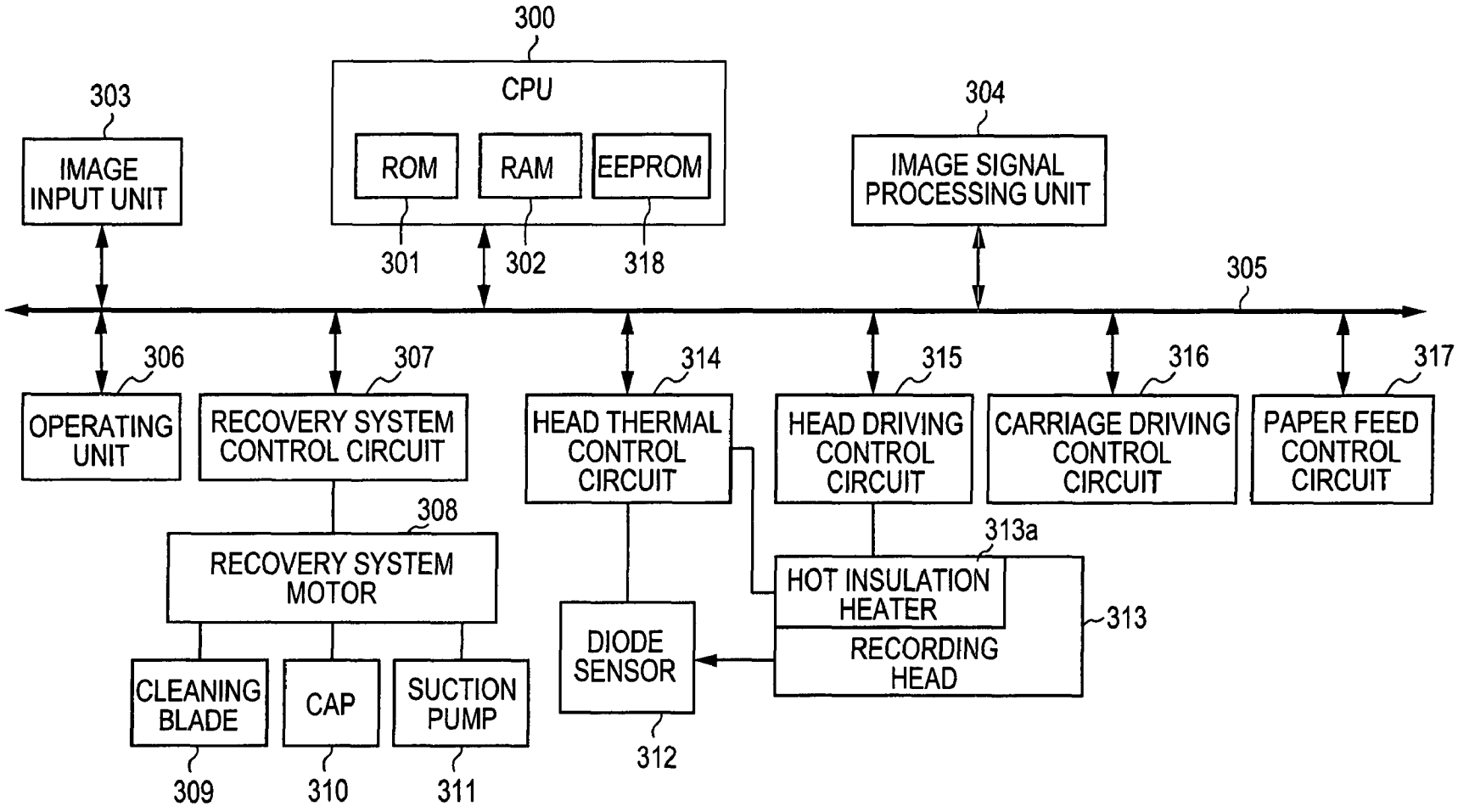
FIG. 3 is a block diagram illustrating the control configuration of the ink-jet recording apparatus.

FIG. 3 is a block diagram illustrating the control configuration of an ink-jet recording apparatus according to each example of the present invention. Note that the mechanical configuration of an ink-jet recording apparatus according to each example of the present invention is the same as shown in FIG. 1.

FIG. 3 is a schematic diagram illustrating the control configuration of an ink-jet recording apparatus. The ink-jet recording apparatus comprises a software system processing unit such as an image input unit 303, an image signal processing unit 304 corresponding thereto, a central control unit (CPU) 300, and the like, and an operating unit 306, each of which has access to a main bus line 305. Also, the ink-jet recording apparatus comprises a recovery system control circuit 307, a head thermal control circuit 314, and a head driving control circuit 315 as a hardware system processing unit. Also, the ink-jet recording apparatus comprises a carriage driving control circuit 316 for controlling driving of the carriage 106 in the main scanning direction, a paper feed control circuit 317 for controlling paper feeding of a recording medium in the sub scanning direction, and the like as another hardware system processing unit.

The CPU 300 comprises ROM (Read Only Memory) 301, RAM (memory of which arbitrary address can be accessed) 302, and EEPROM (Electronically Erasable and Programmable Read Only Memory) 318. Also, the CPU 300 drives a recording head 313 by giving appropriate recording conditions corresponding to input information to perform recording. Also, a program, which executes the recovery timing chart of the recording head 313, is stored in the RAM 302 beforehand, which provides recovery conditions such as a preliminary discharge condition, and the like to the recovery system control circuit 307, the recording head 313, a heat-maintaining heater 313*a*, and the like as necessary.

A recovery system motor 308 drives the recording head 313, a cleaning blade 309 facing and estranging the recording head 313, a cap 310, and a suction pump 311. The head driving control circuit 315 executes the driving conditions of the ink discharge electrothermal conversion member of the recording head 313, and usually controls the recording head 313 to perform preliminary discharge and recording ink discharge.

On the other hand, with the board on which the ink discharge electrothermal conversion member of the recording head 313 is provided, the heat-maintaining heater 313*a* is sometimes provided thereupon, and in this case, an ink temperature within the recording head 313 can be heated and adjusted to a desired preset temperature. Also, a diode sensor 312 is also provided on the board, for measuring a substantial ink temperature within the recording head 313. The diode sensor 312 may be provided outside of the board, or may be disposed in the vicinity of the recording head 313.

Note that the ink-jet recording apparatus can be connected with a host computer (not shown) which supplies recording data for performing recording at the ink-jet recording apparatus. The host computer generates recording data for realizing recording actions, and controls output of the recording data to the ink-jet recording apparatus. Generation and output control of this recording data is realized by a dedicated program such as a printer driver corresponding to the ink-jet recording apparatus installed in the host computer for example, but the processing to be performed by the dedicated program may be realized by dedicated hardware instead of the dedicated program.

Also, the host computer comprises standard components (e.g., CPU, RAM, ROM, hard disk, external storage device, network interface, display, keyboard, mouse, etc.) to be connected to a general-purpose computer.

Next, description will be made regarding the schematic configuration of the ink-jet recording apparatus with reference to FIG. 4.

Figure 4:
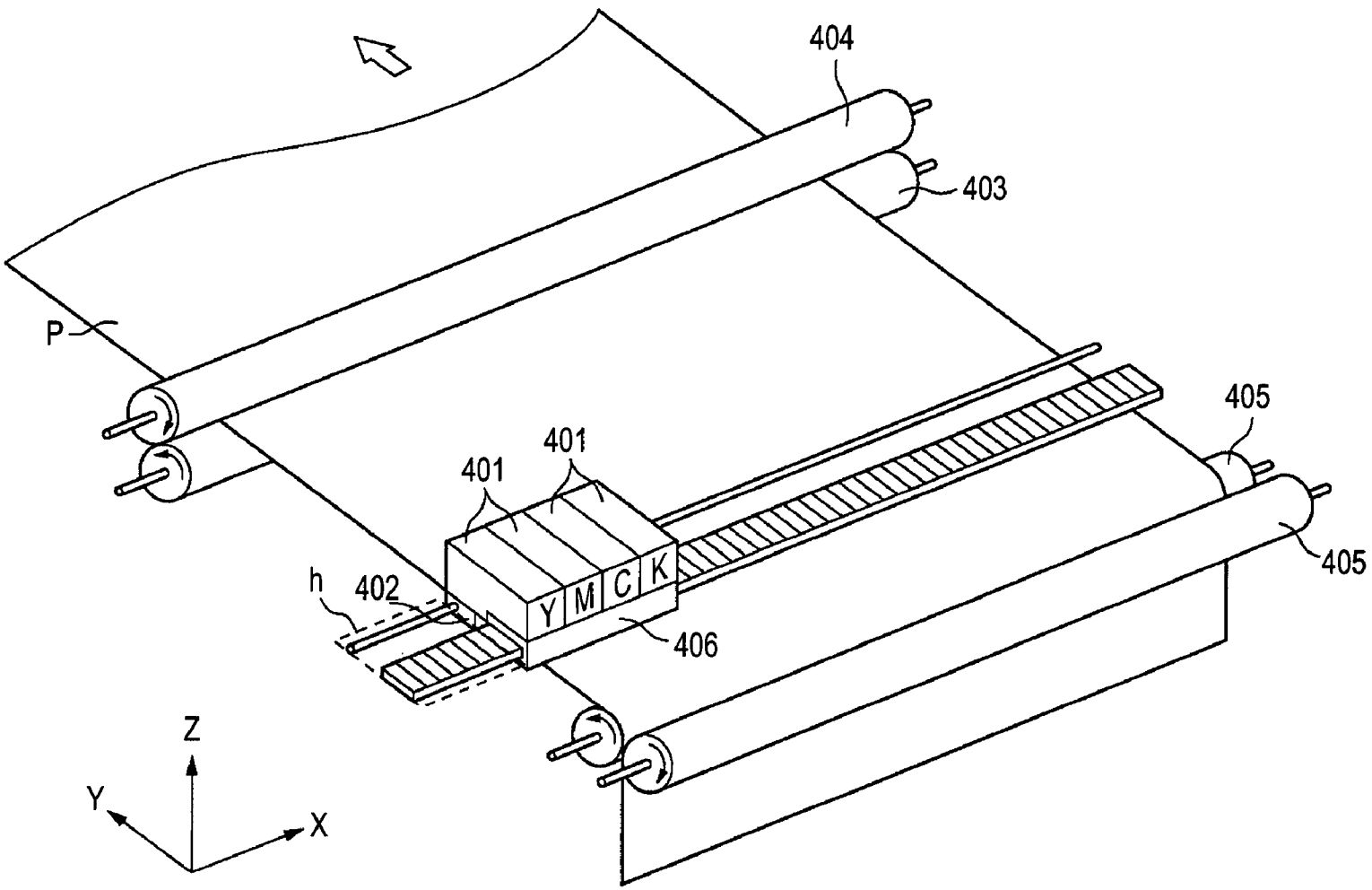
FIG. 4 is a diagram illustrating the schematic configuration of the ink-jet recording apparatus.

FIG. 4 is a diagram illustrating the schematic configuration of an ink-jet recording apparatus according to examples of the present invention.

FIG. 4 illustrates the configuration of a printer unit at the time of recording on a recording medium using a recording head. In FIG. 4, reference numeral 401 denotes ink cartridges. These comprise ink tanks into which four-colored ink, black, cyan, magenta, and yellow ink are filled, and the same recording heads 402 corresponding to the respective colors. It is in FIG. 2 that a scene of ink discharge orifices arrayed on the recording heads 402 is illustrated from the Z direction, and reference numeral 201 denotes a plurality of ink discharge orifices arrayed on the recording heads 402.

Returning to FIG. 4 again, reference numeral 403 denotes a paper feed roller, which rotates in the direction of the arrow in the drawing while suppressing a recording medium P along with an auxiliary roller (paper discharge roller) 404, and conveys the recording medium P in the Y direction (sub scanning direction) as needed. Also, reference numeral 405 denotes a paper supply roller, which supplies the recording medium P, and also serves as a role for suppressing the recording medium P as well as the paper feed roller 403 and the paper discharge roller 404.

The paper discharge roller 404 is disposed closer to the discharge side than the recording head 402. Following the recording medium P being paper-supplied (supplied) from the paper supply opening (supply opening) of the ink-jet recording apparatus, the paper discharge roller 404 conveys the recording medium P corresponding to the recording actions of the recording head 402 sequentially. The paper discharge roller 404 is disposed between the paper-discharge (discharge) position where the recording medium P is paper-discharged (discharged) outside from the paper discharge opening of the ink-jet recording apparatus, and the positions of the recording heads 402.

Reference numeral 406 denotes a carriage, which supports the ink cartridges 401, and moves these in accordance with recording. This is configured so as to stand by at a home position h illustrated with a dotted line in the drawing when recording is not performed, or when the recovery work of the recording heads 402 or the like is performed.

Upon a recording start command being received, the carriage 406 disposed at the position (home position h) in the drawing before starting recording performs recording by discharging a recording material (ink) on the recording medium P from the plurality of ink discharge orifices 201 on the recording heads 402 while moving in the X direction (main scanning direction). Upon recording for forming an image being completed up to the end portion of the recording medium P disposed on the opposite side of the home position h, the carriage 406 returns to the original home position h, and performs simplex recording for repeating recording in the X direction again.

Upon a recording start command being received, the carriage 406 disposed at the position in the drawing before starting recording performs recording by discharging a recording material (ink) on the recording medium P by the plurality of ink discharge orifices 201 on the recording heads 402 while moving in the X direction (main scanning direction). Note that the position of the carriage 406 shown in the drawing before starting recording is the home position h. Upon recording for forming an image being completed up to the end portion of the recording medium P disposed on the opposite side of the home position h, the carriage 406 returns to the original home position h, and performs two-way (outward and homeward) recording for repeating recording in the X direction again.

Description will be made below regarding several examples of the present invention based on the above apparatus configuration.

First Example

Figure 2:
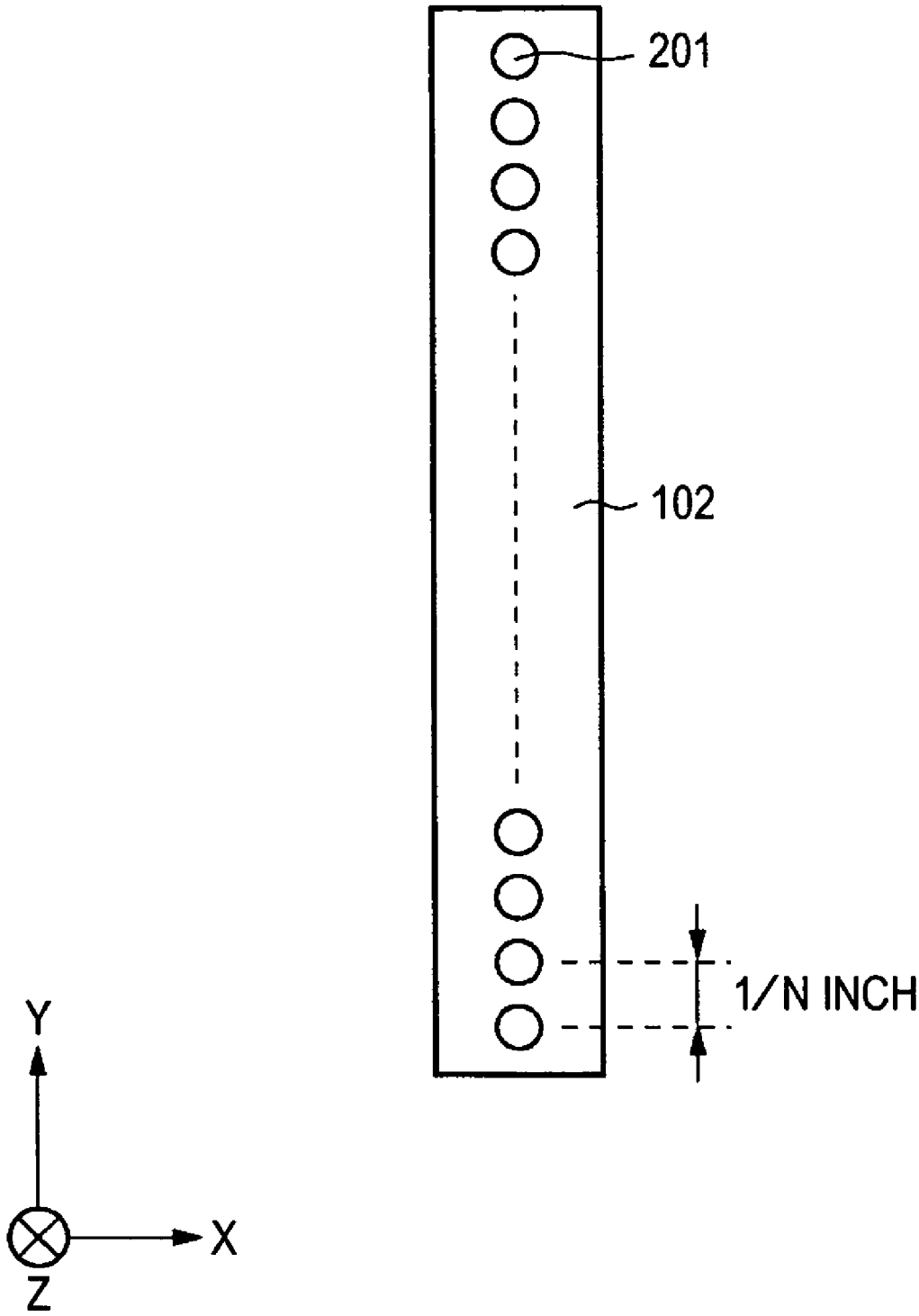
FIG. 2 is a diagram schematically illustrating the nozzle array in a recording head according to the ink-jet method.

With a first example, the single recording head 402 made up of the ink discharge orifices shown in FIG. 2 being lined up is provided, and this recording head 402 discharges black ink. The recording head 402 is configured such that recording pixel density becomes 1200 dpi by the number L of ink discharge orifices=256, and the interval of the ink discharge orifices is 1/1200 inch. With the first example, recording is performed using all of the ink discharge orifices.

Also, the recording head 402 is configured such that the amount of ink discharge from the recording head 402, for example, around 4 pl ink droplets per one droplet can be discharged, and the discharge frequency for discharging these ink droplets in a stable manner is, for example, 24 kHz, and discharge speed is, for example, around 20 m/sec. The speed of the carriage 406 mounting this recording head 402 in the main scanning direction becomes around 20 inches/sec, when recording ink droplets in the main scanning direction with 1200-dpi intervals.

Figure 5:
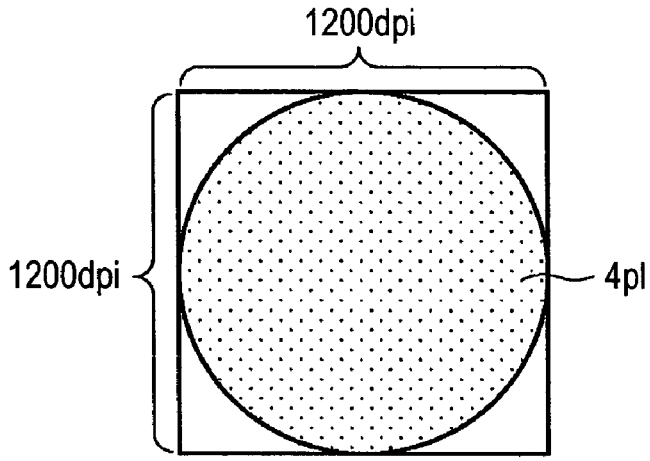
FIG. 5 is a diagram illustrating an example of 100% recording duty with a first example of the present invention.

Now, description will be made regarding 100% recording duty in such a case with reference to FIG. 5. FIG. 5 is a diagram illustrating the 100% recording duty of the first example of the present invention.

With the first example, it is defined as 100% recording duty that one dot is made up of the ink droplets of the amount of discharge 4 pl as to 1200 dpi×1200 dpi pixels.

Also, let us say that the amount of data per one pixel of 1200 dpi×1200 dpi is 1 bit made up of "no dots" and "dots" as to the grid of 1200 dpi×1200 dpi.

Description will be made regarding a case of simplex recording wherein each image region is completed in the outward main scanning direction using the recording head 402, and an intermission period is provided between the outward main scanning and homeward main scanning with reference to FIGS. 4, 6, 7, 8, 9, and 10.

First, description will be made regarding an example of a recording image according to the first example with reference to FIG. 6.

Figure 6:
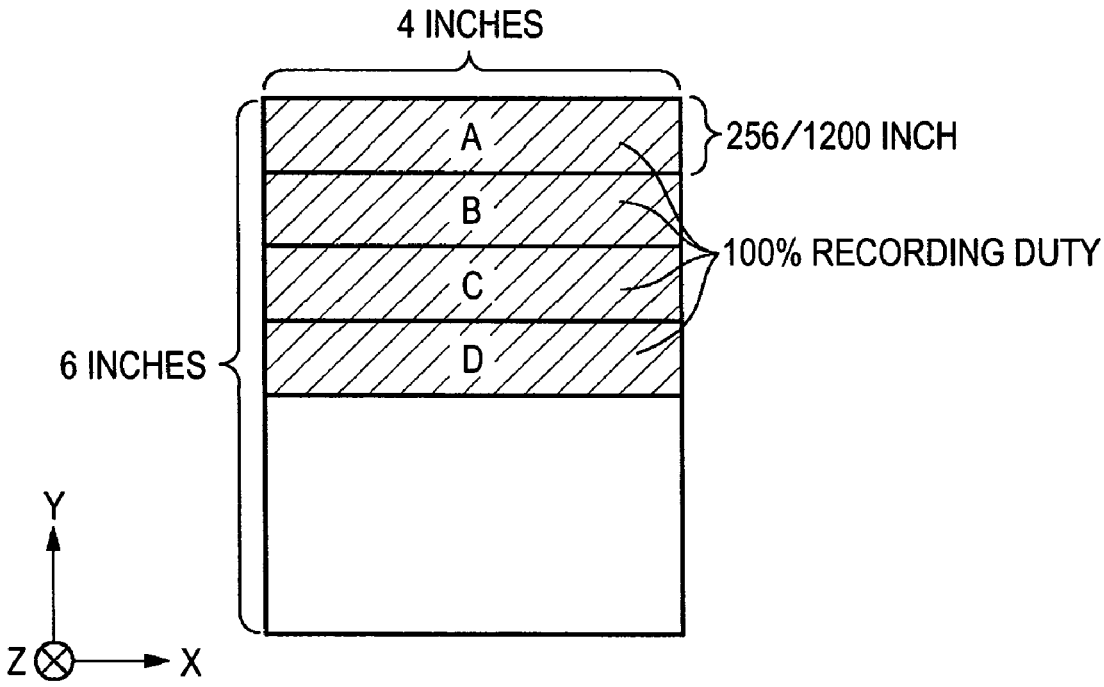
FIG. 6 is a diagram illustrating a recording image with the first example of the present invention.

FIG. 6 is a diagram illustrating the recording image according to the first embodiment of the present invention. In FIG. 6, for example, an example of glossy paper which can obtain an image having a 4×6 inch size and photographic image quality is illustrated as the recording medium P. Also, as for a recording image to be recorded on this recording medium P, respective image regions A through D are images having 100% recording duty and a 256/1200×4 inch size.

Figure 7:
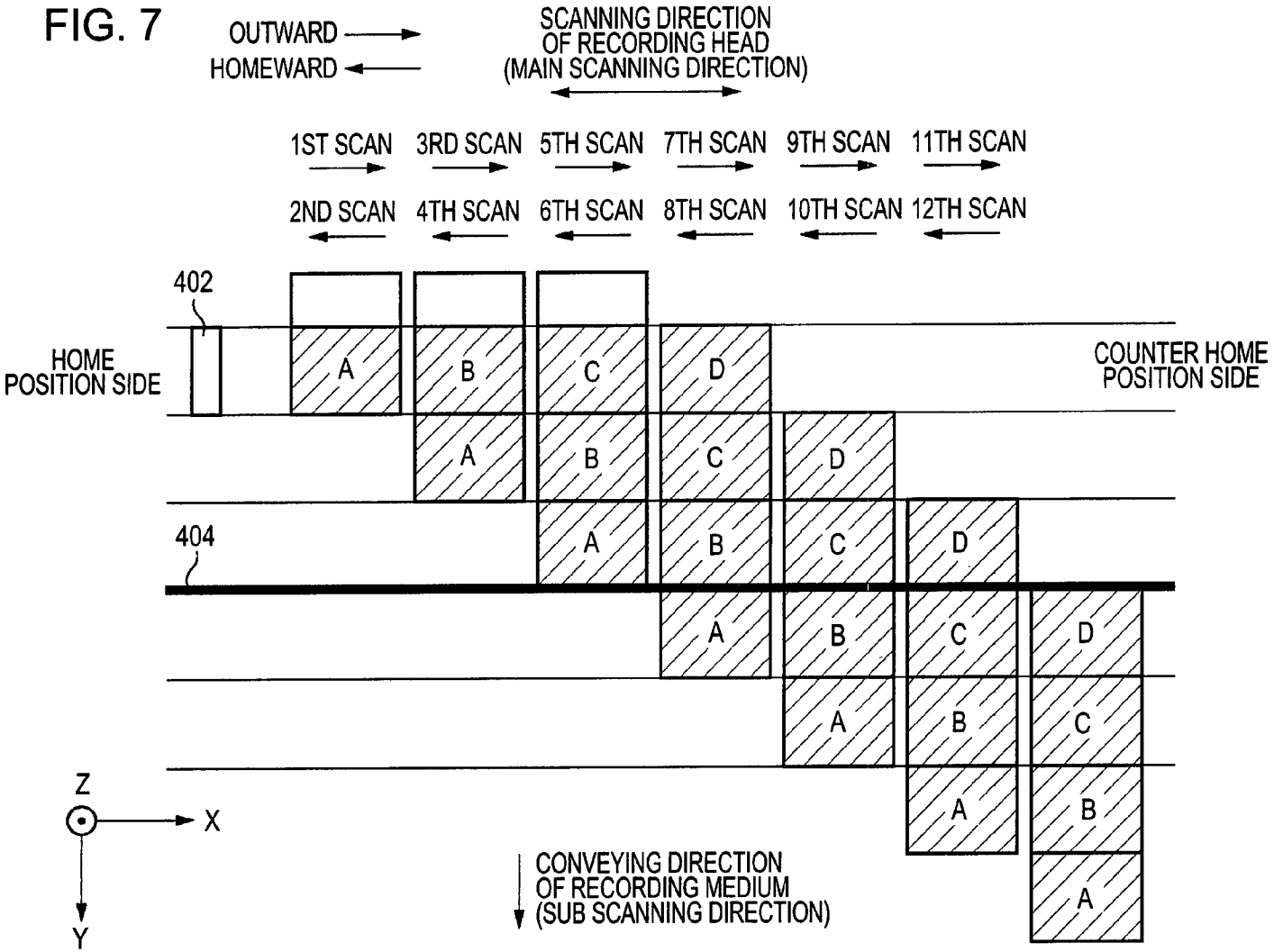
FIG. 7 is a diagram illustrating recording actions with the first example of the present invention.

Next, description will be made regarding recording actions according to the first example of the present invention with reference to FIG. 7. FIG. 7 is a diagram illustrating recording actions according to the first example of the present invention.

In FIG. 7, the relation between the recording head 402 and recording at each scanning when recording an image is illustrated. In the case of FIG. 7, with a first scan, ink droplets are discharged from each ink discharge orifices of the recording head 402 to record the image region A, and the image region A is completed. With a second scan, the recording head 402 is returned to the home position h side.

Similarly, with a third scan, ink droplets are discharged from each ink discharge orifices of the recording head 402 to record the image region B, and the image region B is completed. With a fourth scan, the recording head 402 is returned to the home position h side.

Similarly, with a fifth scan, ink droplets are discharged from each ink discharge orifices of the recording head 402 to record the image region C, and the image region C is completed. With a sixth scan, the recording head 402 is returned to the home position h side.

Similarly, with a seventh scan, ink droplets are discharged from each ink discharge orifices of the recording head 402 to record the image region D, and the image region D is completed. With an eighth scan, the recording head 402 is returned to the home position h side.

Figures 8, 9:
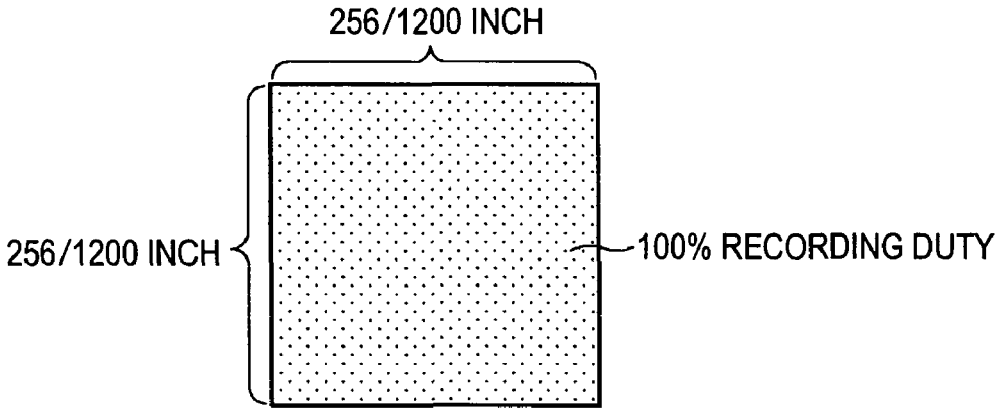
FIG. 8 is a diagram illustrating a patch with the first example of the present invention.
FIG. 9 is a diagram illustrating evaluation results of a period up to passing through a paper discharge roller, and contamination levels of the paper discharge roller and a recording surface described in the first example of the present invention.

FIG. 8 is a diagram illustrating a patch having 100% recording duty and a 256/1200 inch square size. The number of recording dots within the 256/1200 inch square patch becomes 256 dots×256 dots=65536 dots since recording duty is 100%.

FIG. 9 is a table illustrating the relations between a period from completion of the image in FIG. 8 up to passing through the paper discharge roller 404, and a contamination level of the paper discharge roller 404 and a contamination transfer level to the recording surface of the recording medium P from the contaminated paper discharge roller 404.

The table in FIG. 9 shows evaluation results obtained by changing a period from completion of the image in FIG. 8 up to passing through the paper discharge roller 404, such as 0.4 sec, 3.6 sec, 7.6 sec, 10.6 sec, and 13.6 sec, and evaluating a contamination level of the paper discharge roller 404 and the recording surface of the recording medium P at that time.

0.4 sec at this time is a case wherein paper discharging of the recording medium P is performed by repeating scanning in the sub scanning direction alone.

In FIG. 9, cases wherein the paper discharge roller 404 has no contamination and the recording surface of the recording medium P has no contamination from the paper discharge roller 404 are indicated by circles.

Cases wherein the paper discharge roller 404 has serious contamination and the recording surface of the recording medium P has serious contamination from the paper discharge roller 404 are indicated by crosses.

Also, the case wherein the paper discharge roller 404 has some contamination, but the recording surface of the recording medium P has no contamination transferred from the paper discharge roller 404 is indicated by a triangle.

It has been found from the evaluation results that in the event that a period from completion of the image in FIG. 8 up to passing through the paper discharge roller 404 is 10.6 or more, contamination as to the paper discharge roller 404 and the recording surface of the recording medium does not occur.

Figure 10:
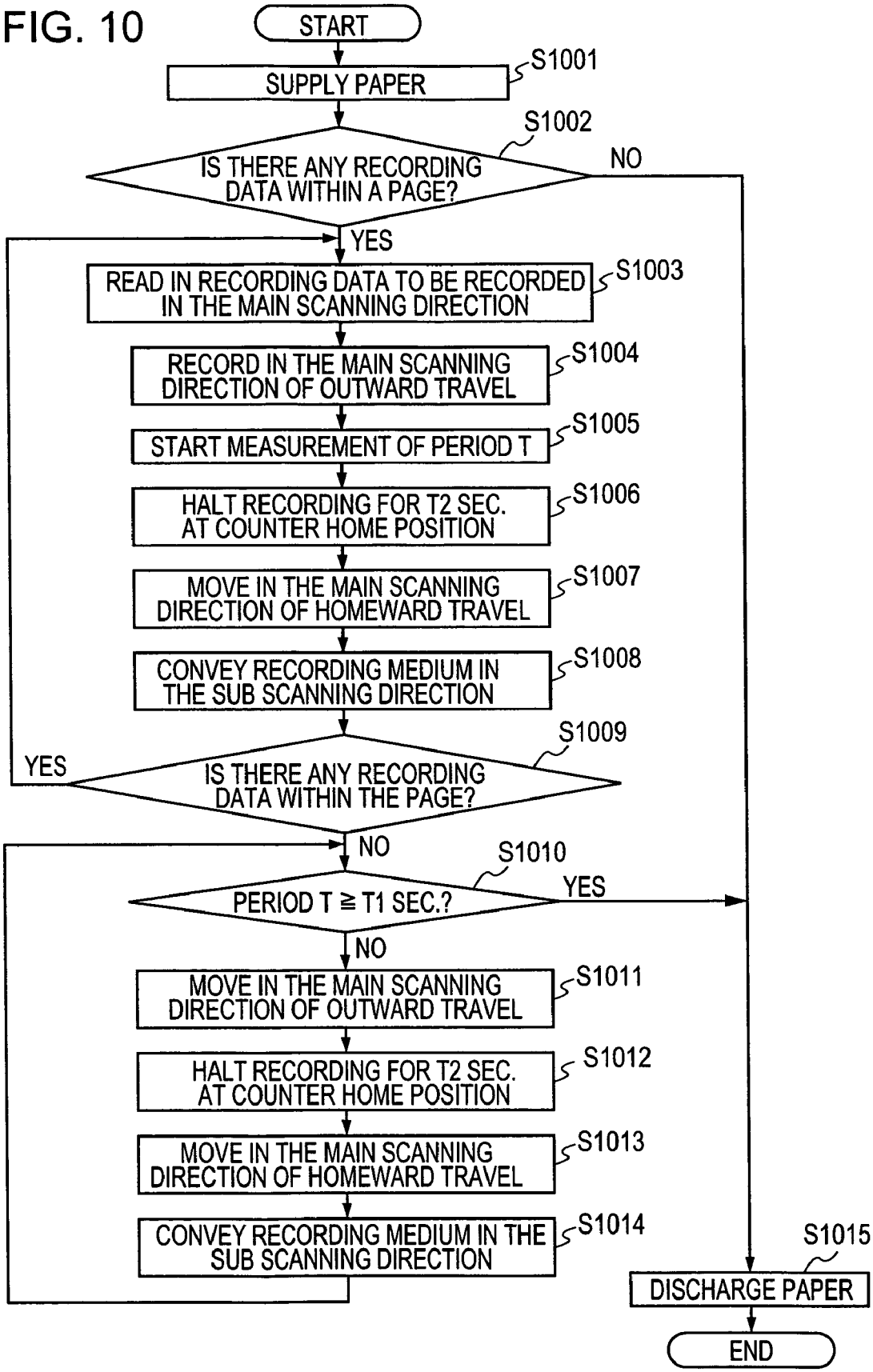
FIG. 10 is a flowchart illustrating the recording actions of an ink-jet recording apparatus to which the present invention can be applied.

Next, description will be made regarding recording actions of an ink-jet recording apparatus according to the first example with reference to FIG. 10. FIG. 10 is a flowchart illustrating recording actions of the ink-jet recording apparatus according to the first example of the present invention.

In FIG. 10, a case wherein the image regions A through D shown in FIG. 6 are recorded will be described as an example.

First, in Step S1001, paper feeding of the recording medium P is performed. In Step S1002, determination is made whether or not recording data to be recorded exists within one page of the recording medium P. In the event of no recording data (NO in Step S1002), the flow proceeds to Step S1015. On the other hand, in the event that recording data exists (YES in Step S1002), the flow proceeds to Step S1003.

In this case, the image region A shown in FIG. 6 is recorded, so determination is made that there is recording data to be recorded within the page, and the flow proceeds to Step S1003.

In Step S1003, recording data to be recorded in the main scanning direction is read in. In this case, the recording data corresponding to the image region A is read in. In Step S1004, recording is performed while moving the recording head 402 in the outward main scanning direction. In the case of FIG. 7, recording of the image region A is performed at the first scan while moving the recording head 402 in the outward main scanning direction.

In Step S1005, measurement of a period T from completion of recording is started. In Step S1006, as an intermission period, recording is halted at the counter home position for a predetermined period T2 (10 sec in this case).

In Step S1007, following the halt, the recording head 402 is moved in the homeward main scanning direction. In Step S1008, upon the recording head 402 returning to the home position h side, the recording medium P is conveyed by a predetermined amount (256/1200 inch in this case) in the sub scanning direction by the paper feed roller 403 and the paper discharge roller 404.

Up to now, the period T has been measured as 10.2 sec obtained by aggregating the intermission period T2=10 sec between the outward main scanning direction at the first scan and the homeward main scanning direction at the second scan, and 0.2 sec required for the homeward main scanning at the second scan.

Next, in Step S1009, determination is made whether or not recording data to be recorded exists within the page. In the event of no recording data (NO in Step S1009), the flow proceeds to Step S1010. On the other hand, in the event that recording data exists (YES in Step S1009), the flow returns to Step S1003.

In this case, the image region B shown in FIG. 6 is recorded, so determination is made that there is recording data to be recorded within the page, and the flow returns to Step S1003.

As for recording actions as to the image region B, in Step S1003, the recording data corresponding to the image region B is read in. In Step S1004, recording of the image region B is performed at the third scan in FIG. 7 while moving the recording head 402 in the outward main scanning direction. Next, in Step S1005, the value of the period T is overwritten, and measurement of the period T from completion of recording at the third scan is started again.

Next, in Step S1006, as an intermission period, recording is halted at the counter home position for the predetermined period T2=10 sec. In Step S1007, following the halt, the recording head 402 is moved in the homeward main scanning direction at the fourth scan in FIG. 7. In Step S1008, upon the recording head 402 returning to the home position h side, the recording medium P is conveyed by a predetermined length (256/1200 inch in this case) in the sub scanning direction by the paper feed roller 403 and the paper discharge roller 404.

Up to now, the period T has been measured as 10.2 sec obtained by aggregating the intermission period T2=10 sec between the outward main scanning direction at the third scan and the homeward main scanning direction at the fourth scan, and 0.2 sec required for the homeward main scanning at the fourth scan.

Also, at this point, a period Ta from completion of the image region A becomes 20.6 sec obtained by aggregating the intermission period T2=10 sec between the outward main scanning direction at the first scan and the homeward main scanning direction at the second scan, the intermission period T2=10 sec between the outward main scanning direction at the third scan and the homeward main scanning direction at the fourth scan, 0.2 sec required for the homeward main scanning at the second scan, 0.2 sec required for the outward main scanning at the third scan, and 0.2 sec required for the homeward main scanning at the fourth scan.

Next, with determination in Step S1009, the image region C shown in FIG. 6 is recorded, so determination is made that recording data to be recorded exists within the page, and the flow returns to Step S1003.

As for recording actions as to the image region C, in Step S1003, the recording data corresponding to the image region C is read in. In Step S1004, recording of the image region C is performed at the fifth scan in FIG. 7 while moving the recording head 402 in the outward main scanning direction. Next, in Step S1005, the value of the period T is overwritten, and measurement of the period T from completion of recording at the fifth scan is started again.

In Step S1006, as an intermission period, recording is halted at the counter home position for the predetermined period T2=10 sec. In Step S1007, following the halt, the recording head 402 is moved in the homeward main scanning direction at the sixth scan in FIG. 7. In Step S1008, upon the recording head 402 returning to the home position h, the recording medium P is conveyed by a predetermined length (256/1200 inch in this case) in the sub scanning direction by the paper feed roller 403 and the paper discharge roller 404.

Up to now, the period T has been measured as 10.2 sec obtained by aggregating the intermission period T2=10 sec between the outward main scanning direction at the fifth scan and the homeward main scanning direction at the sixth scan, and 0.2 sec required for the homeward main scanning at the sixth scan.

Also, at this point, the period Ta from completion of the image region A becomes 31 sec obtained by aggregating the intermission period T2=10 sec between the outward main scanning direction at the first scan and the homeward main scanning direction at the second scan, the intermission period T2=10 sec between the outward main scanning direction at the third scan and the homeward main scanning direction at the fourth scan, the intermission period T2=10 sec between the outward main scanning direction at the fifth scan and the homeward main scanning direction at the sixth scan, 0.2 sec required for the homeward main scanning at the second scan, 0.2 sec required for the outward main scanning at the third scan, 0.2 sec required for the homeward main scanning at the fourth scan, 0.2 sec required for the outward main scanning at the fifth scan, and 0.2 sec required for the homeward main scanning at the sixth scan.

Also, at this point, a period Tb from completion of the image region B becomes 20.6 sec obtained by aggregating the intermission period T2=10 sec between the outward main scanning direction at the third scan and the homeward main scanning direction at the fourth scan, the intermission period T2=10 sec between the outward main scanning direction at the fifth scan and the homeward main scanning direction at the sixth scan, 0.2 sec required for the homeward main scanning at the fourth scan, 0.2 sec required for the outward main scanning at the fifth scan, and 0.2 sec required for the homeward main scanning at the sixth scan.

Next, with the determination in Step S1009, the image region D shown in FIG. 6 is recorded, so determination is made that recording data to be recorded exists within the page, and the flow returns to Step S1003.

As for recording actions as to the image region D, in Step S1003, the recording data corresponding to the image region D is read in. In Step S1004, recording of the image region D is performed at the seventh scan in FIG. 7 while moving the recording head 402 in the outward main scanning direction. Next, in Step S1005, the value of the period T is overwritten, and measurement of the period T from completion of recording at the seventh scan is started again.

In Step S1006, as an intermission period, recording is halted at the counter home position for the predetermined period T2=10 sec. In Step S1007, following the halt, the recording head 402 is moved in the homeward main scanning direction at the eighth scan in FIG. 7. In Step S1008, upon the recording head 402 returning to the home position h side, the recording medium P is conveyed by a predetermined length (256/1200 inch in this case) in the sub scanning direction by the paper feed roller 403 and the paper discharge roller 404.

Up to now, the period T has been measured as 10.2 sec obtained by aggregating the intermission period T2=10 sec between the outward main scanning direction at the seventh scan and the homeward main scanning direction at the eighth scan, and 0.2 sec required for the homeward main scanning at the eighth scan.

Also, at this point, the period Tb from completion of the image region B becomes 31 sec obtained by aggregating the intermission period T2=10 sec between the outward main scanning direction at the third scan and the homeward main scanning direction at the fourth scan, the intermission period T2=10 sec between the outward main scanning direction at the fifth scan and the homeward main scanning direction at the sixth scan, the intermission period T2=10 sec between the outward main scanning direction at the seventh scan and the homeward main scanning direction at the eighth scan, 0.2 sec required for the homeward main scanning at the fourth scan, 0.2 sec required for the outward main scanning at the fifth scan, 0.2 sec required for the homeward main scanning at the sixth scan, 0.2 sec required for the outward main scanning at the seventh scan, and 0.2 sec required for the homeward main scanning at the eighth scan.

Also, at this point, a period Tc from completion of the image region C becomes 20.6 sec obtained by aggregating the intermission period T2=10 sec between the outward main scanning direction at the fifth scan and the homeward main scanning direction at the sixth scan, the intermission period T2=10 sec between the outward main scanning direction at the seventh scan and the homeward main scanning direction at the eighth scan, 0.2 sec required for the homeward main scanning at the sixth scan, 0.2 sec required for the outward main scanning at the seventh scan, and 0.2 sec required for the homeward main scanning at the eighth scan.

Also, at this point, the period Ta from completion of the image region A becomes 41.2 sec obtained by aggregating the intermission period T2=10 sec between the outward main scanning direction at the first scan and the homeward main scanning direction at the second scan, the intermission period T2=10 sec between the outward main scanning direction at the third scan and the homeward main scanning direction at the fourth scan, the intermission period T2=10 sec between the outward main scanning direction at the fifth scan and the homeward main scanning direction at the sixth scan, the intermission period T2=10 sec between the outward main scanning direction at the seventh scan and the homeward main scanning direction at the eighth scan, 0.2 sec required for the homeward main scanning at the second scan, 0.2 sec required for the outward main scanning at the third scan, 0.2 sec required for the homeward main scanning at the fourth scan, 0.2 sec required for the outward main scanning at the fifth scan, 0.2 sec required for the homeward main scanning at the sixth scan, 0.2 sec required for the outward main scanning at the seventh scan, and 0.2 sec required for the homeward main scanning at the eighth scan. That is to say, following recording of the image region A being completed, the recording medium P passes through the paper discharge roller 404 after the elapsing of 41.2 sec.

Next, with the determination in Step S1009, determination is made that no recording data to be recorded exists within the page since no image region to be recorded exists on the side closer to the paper discharging side than the image region D shown in FIG. 6, and the flow proceeds to Step S1010.

In Step S1010, determination is made regarding whether or not the period T from completion of the image region D is a predetermined period T1 (10.6 sec in this case) or more. In the event that the period T is the predetermined period T1 or more (YES in Step S1010), the flow proceeds to Step S1015. On the other hand, in the event that the period T is less than the predetermined period T1 (NO in Step S1010), the flow proceeds to Step S1011.

In this case, the period T from completion of the image region D is 10.2 sec, so is less than the predetermined period T1 (=10.6 sec), and the flow proceeds to Step S1011.

In Step S1011, the recording head 402 is moved in the outward main scanning direction at the ninth scan in FIG. 7. In Step S1012, as an intermission period, recording is halted at the counter home position for the predetermined period T2=10 sec. In Step S1013, following the halt, the recording head 402 is moved in the homeward main scanning direction at the tenth scan in FIG. 7.

In Step S1014, upon the recording head 402 returning to the home position h side, the recording medium P is conveyed by a predetermined amount ($^{256}/_{1200}$ inch in this case) in the sub scanning direction by the paper feed roller 403 and the paper discharge roller 404.

In Step S1010, determination is made again regarding whether or not the period T from completion of the image region D is the predetermined period T1 (=10.6 sec) or more.

At this time, the period T becomes 20.6 sec obtained by aggregating the intermission period T2=10 sec between the outward main scanning direction at the seventh scan and the homeward main scanning direction at the eighth scan, the intermission period T2=10 sec between the outward main scanning direction at the ninth scan and the homeward main scanning direction at the tenth scan, 0.2 sec required for the homeward main scanning at the eighth scan, 0.2 sec required for the outward main scanning at the ninth scan, and 0.2 sec required for the homeward main scanning at the tenth scan.

Also, at this point, the period Tb from completion of the image region B becomes 41.2 sec obtained by aggregating the intermission period T2=10 sec between the outward main scanning direction at the third scan and the homeward main scanning direction at the fourth scan, the intermission period T2=10 sec between the outward main scanning direction at the fifth scan and the homeward main scanning direction at the sixth scan, the intermission period T2=10 sec between the outward main scanning direction at the seventh scan and the homeward main scanning direction at the eighth scan, the intermission period T2=10 sec between the outward main scanning direction at the ninth scan and the homeward main scanning direction at the tenth scan, 0.2 sec required for the homeward main scanning at the fourth scan, 0.2 sec required for the outward main scanning at the fifth scan, 0.2 sec required for the homeward main scanning at the sixth scan, 0.2 sec required for the outward main scanning at the seventh scan, 0.2 sec required for the homeward main scanning at the eighth scan, 0.2 sec required for the outward main scanning at the ninth scan, and 0.2 sec required for the homeward main scanning at the tenth scan. That is to say, following recording of the image region B being completed, the recording medium P passes through the paper discharge roller 404 after the elapsing of 41.2 sec.

Also, at this point, the period Tc from completion of the image region C becomes 31 sec obtained by aggregating the intermission period T2=10 sec between the outward main scanning direction at the fifth scan and the homeward main scanning direction at the sixth scan, the intermission period T2=10 sec between the outward main scanning direction at the seventh scan and the homeward main scanning direction at the eighth scan, the intermission period T2=10 sec between the outward main scanning direction at the ninth scan and the homeward main scanning direction at the tenth scan, 0.2 sec required for the homeward main scanning at the sixth scan, 0.2 sec required for the outward main scanning at the seventh scan, 0.2 sec required for the homeward main scanning at the eighth scan, 0.2 sec required for the outward main scanning at the ninth scan, and 0.2 sec required for the homeward main scanning at the tenth scan.

In this case, the period T becomes 20.6 sec, which is the predetermined period T1 (=10.6 sec) or more, so the flow proceeds to Step S1015, where the recording medium P is discharged.

As described above, according to the first example, with the main scanning direction, the width X1 in the main scanning direction of the image region of which the recording width in the main scanning direction is the shortest of all of the image regions to be recorded on the recording surface of the recording medium P becomes 4 inches in the case of FIG. 6.

FIG. 6 illustrates the multiple image regions A through D divided in the sub scanning direction. These image regions A through D correspond to an image region W1. The image regions A through D are regions recorded by scanning the recording head 402 once. The paper discharge roller 404, which conveys the recording medium P while coming into contact with the recording surface of the recording medium P, is disposed on the side closer to the paper discharging side than the recording head 402. The width between the ink discharge orifice closest to the paper discharging side of the ink discharge orifices employed for recording of the image regions A through D, and the paper discharge roller 404 becomes $^{256}/_{1200}$ (inch)×3 (number of scanning), i.e., $^{768}/_{1200}$ (inch). The width Y1 obtained by subtracting $^{256}/_{1200}$ (inch) serving as the width of the ink discharge orifice employed for recording from that width, $^{768}/_{1200}$ (inch) becomes $^{512}/_{1200}$ (inch).

An image region W2 defined by the width X1 and the width Y1 becomes the same size as an image region obtained by combining two of the image region A and the image region B.

Thus, the period T1 necessary for completing the image region W2 obtained by combining two of the image region A and the image region B with the first example becomes 10.6 sec obtained by aggregating 0.2 sec required for the outward main scanning at the first scan, the intermission period T2=10 sec between the outward main scanning direction at the first scan and the homeward main scanning direction at the second scan, 0.2 sec required for the homeward main scanning at the second scan, and 0.2 sec required for the outward main scanning at the third scan.

The period necessary for coming into contact with the paper discharge roller 404 from the image region to be recorded on the recording surface of the recording medium P having been completed with the first example is after the elapsing of 41.2 sec regarding the image regions A through C, and after the elapsing of 31 sec regarding the image region D. Thus, all of the image regions A through D result in coming into contact with the paper discharge roller 404 after the elapsing of the predetermined period T1 (=10.6 sec) or more. That is to say, as can be understood from the table in FIG. 9, even in a case wherein poor fixing of ink to the recording medium P, a recording image and the paper discharge roller 404 can be prevented from contamination.

Scanning of the recording head 402 and conveyance of the recording medium are performed as to a region including no recording data closer to the paper supplying side than the image region with the first example for (1/3)×T1, i.e., around 3.5 sec or more from the image region D having been completed up to the elapsing of 20.6 sec. The main scanning of the recording head 402 performed at this time is the main scanning of the eighth scan through the tenth scan, three times in a row, shown in FIG. 7, and the sub scanning for conveying the recording medium P is performed once between the eighth scan and the ninth scan. A user can be informed that recording actions have not been completed as to the regions having no recording data closer to the paper supplying side than the image regions by performing the above actions.

For example, upon actions of the recording apparatus being ended immediately following approaching the region including no recording data, the user may determine that recording actions are completed. If the user understanding that recording actions are completed extracts the remaining recording media within the recording apparatus before the recording images on the recording media are sufficiently permeated and fixed, the recording images are deteriorated, and the paper discharge roller is contaminated. As described above, scanning of the recording head and conveyance of the recording medium are performed for a predetermined period as to the region having no recording data, thereby preventing the user from accidentally extracting recording media from the apparatus.

In addition, providing an intermission period between the seventh main scanning and the eighth main scanning, which complete the image region D, and between the ninth main scanning and the tenth main scanning can satisfy a period of (1/3)×T1, i.e., around 3.5 sec or more from the image region D having been completed up to the elapsing of 20.6 sec.

Also, even at the time of paper discharging, the same recording actions as with the recording actions for completing the image regions A through D are performed. Thus configured, as can be understood from the table in FIG. 9, even in the event that fixing of ink to the recording medium P is poor, contamination of recording images and the paper discharge roller 404 caused by the recording surface of the recording medium P rubbing against the paper discharge roller 404 can be prevented.

In addition, employing the paper discharge roller 404 having appropriate conveyance precision in the sub scanning direction of the recording medium P can improve the image quality of the recording image on the recording medium P.

Note that with the first example, the case wherein all of the image regions to be recorded on the recording surface of the recording medium P have 100% recording duty has been described as an example. However, the present invention is not restricted to the configuration of the first example, and even if the image regions have recording duty less than 100%, the same advantages can be obtained by performing the same recording actions.

Second Example

With a second example, description will be made regarding a case wherein two different recording modes of first and second recording modes are provided. Here, the same recording head as with the first example is employed as an example. Also, the definition of 100% recording duty is the same as that in FIG. 5 according to the first example.

Now, the first recording mode and the second recording mode, which are two different types of recording modes, are defined as follows.

The first recording mode is a recording mode wherein as with the first example, for example, the number of times of the main scanning for completing each image region in FIG. 6 is once, simplex recording wherein recording is performed in the outward direction of the main scanning alone is employed, and an intermission period is provided between the outward direction of the main scanning and the homeward direction of the main scanning alone.

The second recording mode is a recording mode wherein, for example, the number of times of the main scanning for completing each image region in FIG. 6 is twice, two-way recording wherein recording is performed in the outward direction and the homeward direction of the main scanning is employed, and an intermission period is provided between the outward direction of the main scanning and the homeward direction of the main scanning, and between the homeward direction of the main scanning and the outward direction of the main scanning.

The recording actions in the first recording mode are the same as those in the first example, so with the second example, description regarding the recording actions in the first recording mode will be omitted.

Description will be made regarding the recording actions in the second recording mode with reference to FIGS. 4, 8, and 9 of the first example, and FIGS. 11, 13, and 14.

First, description will be made regarding an example of a recording image according to the second example with reference to FIG. 11. FIG. 11 is a diagram illustrating the recording image according to the second embodiment of the present invention. In FIG. 11, for example, an example of glossy paper having a 4×6 inch size is illustrated as the recording medium P, as with the first example. Also, as for a recording image to be recorded on this recording medium P, respective image regions A1 through D2 are images having 100% recording duty and a $^{128}/_{1200}$×4 inch size.

Figure 12A:
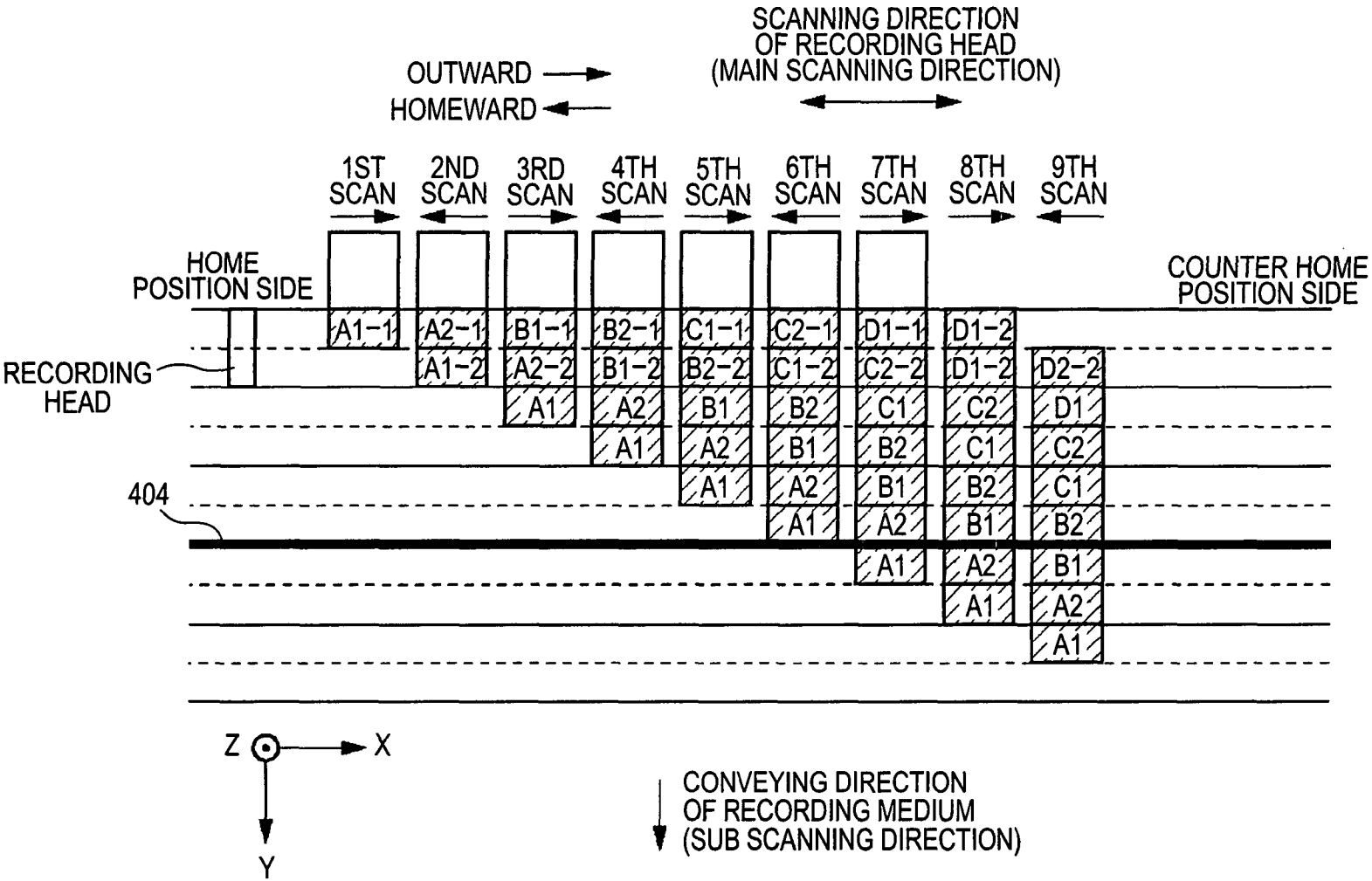
FIG. 12 is a diagram illustrating recording actions with the second example of the present invention.
Figure 12B:
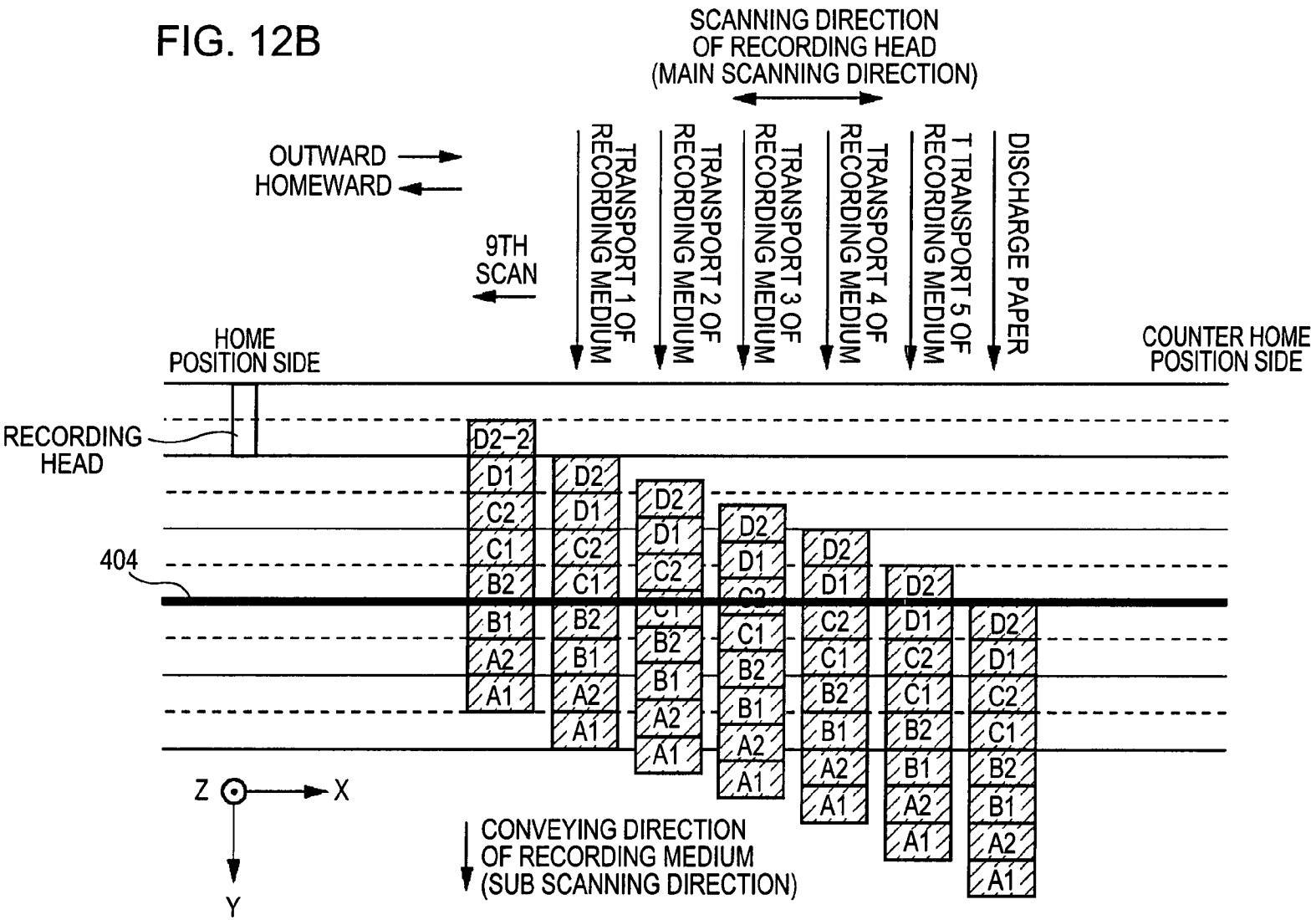

Next, description will be made regarding recording actions according to the second example of the present invention with reference to FIGS. 12A and 12B. FIGS. 12A and 12B are diagrams illustrating recording actions according to the second example of the present invention.

Figure 11:
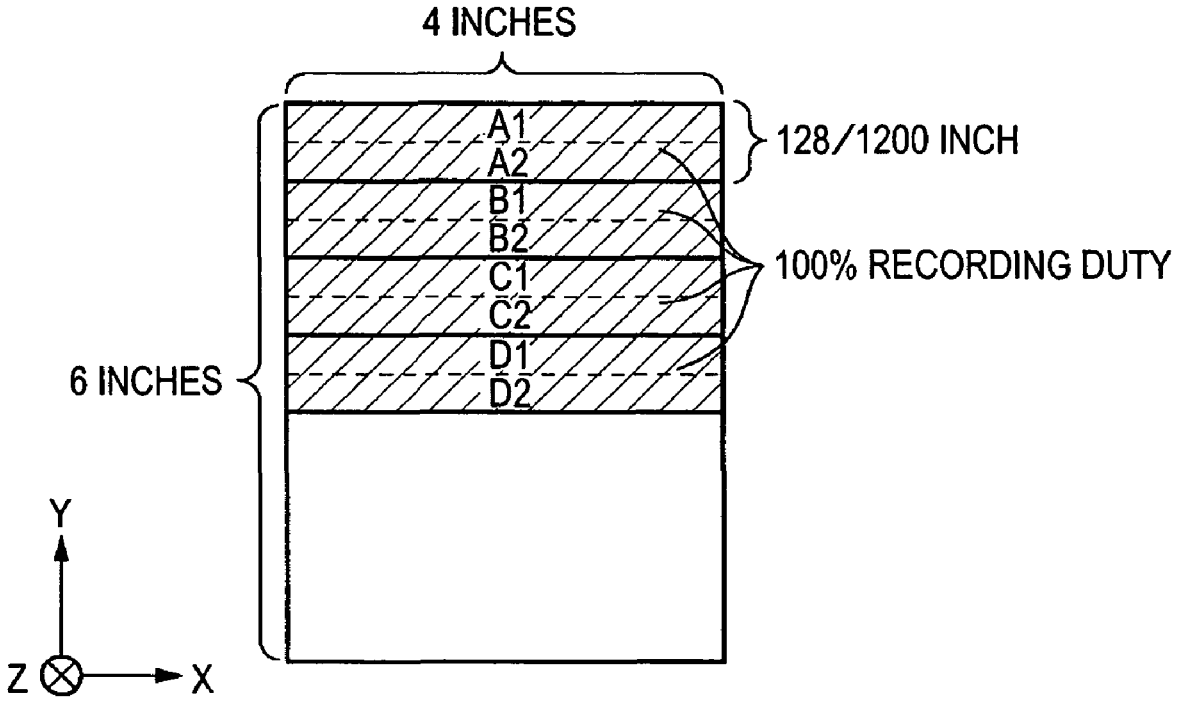
FIG. 11 is a diagram illustrating a recording image described in a second example of the present invention.

In FIGS. 12A and 12B, the relation between the recording head 402 and recording at each scanning when recording the image in FIG. 11 is illustrated.

In FIG. 12A, with a first scan, ink droplets are discharged from each ink discharge orifices of the recording head 402 to record an image region A1-1. With a subsequent second scan, ink droplets are discharged from each ink discharge orifices of the recording head 402 to record an image region A1-2 on the image region A1-1, and complete an image region A1.

Similarly, with the second scan, ink droplets are discharged from each ink discharge orifices of the recording head 402 to record an image region A2-1. With a subsequent third scan, ink droplets are discharged from each ink discharge orifices of the recording head 402 to record an image region A2-2 on the image region A2-1, and complete an image region A2.

Hereinafter, similarly, with a third scan, an image region B1-1 is recorded, and with a subsequent fourth scan, an image region B1-2 in recorded on the image region B1-1, and an image region B1 is completed.

With a subsequent fifth scan, an image region B2-2 is recorded as to an image region B2-1 recorded with the fourth scan, and an image region B2 is completed.

Also, with a subsequent sixth scan, an image region C1-2 is recorded as to an image region C1-1 recorded with the fifth scan, and an image region C1 is completed.

Image recording as to an image region C2 is completed by recording an image region C2-2 with a seventh scan on an image region C2-1 recorded with the sixth scan.

Recording of an image region D1 is completed by recording an image region D1-2 with an eighth scan on an image region D1-1 recorded with the seventh scan.

Also, with a subsequent ninth scan, an image region D2-2 is recorded on an image region D2-1 recorded with the eighth scan. According to this twice-scanning, recording of an image region D2 is completed.

Now, let us say that each period from completion of the twice-main scanning for completing recording of the respective image regions A1 through D2 in FIG. 11 to end of each main scanning thereafter is T, i.e., defined as Ta1, Ta2, Tb1, Tb2, Tc1, Tc2, Td1, and Td2.

FIG. 9 is a table illustrating the relations between a period from completion of the image in FIG. 8 up to passing through the paper discharge roller 404, and a contamination level of the paper discharge roller 404 and a contamination transfer level to the recording surface of the recording medium P from the contaminated paper discharge roller 404.

With the second example, the table in FIG. 9 is evaluation results obtained by changing a period from completion of the image in FIG. 8 up to passing through the paper discharge roller 404, such as 0.4 sec, 2.6 sec, 5.6 sec, 10.6 sec, and 20.6 sec, and evaluating a contamination level of the paper discharge roller 404 and the recording surface of the recording medium P at that time.

0.4 sec at this time is a case wherein paper discharging of the recording medium P is performed by repeating scanning in the sub scanning direction alone.

It has been found from the evaluation results that in the event that a period from completion of the image in FIG. 8 up to passing through the paper discharge roller 404 is 10.6 or more, contamination as to the paper discharge roller 404 and the recording surface of the recording medium does not occur.

FIG. 13 is a diagram illustrating an intermission period during scanning for completing an image region, which is set according to the recording mode.

In the first recording mode, the same recording actions as with the first example is performed, an image region is completed with the single main scanning in the outward direction, and recording is halted for 10 sec at the counter home position between the outward main scanning and the homeward main scanning as an intermission period.

On the other hand, in the second recording mode, an image region is completed with the twice-main scanning in the outward direction and in the homeward direction, and recording is halted for 2.4 sec at the counter home position between the outward main scanning and the homeward main scanning, and at the home position between the homeward main scanning and the outward main scanning, as an intermission period.

Next, description will be made regarding recording actions of an ink-jet recording apparatus according to the second example with reference to FIG. 14.

Figure 14:
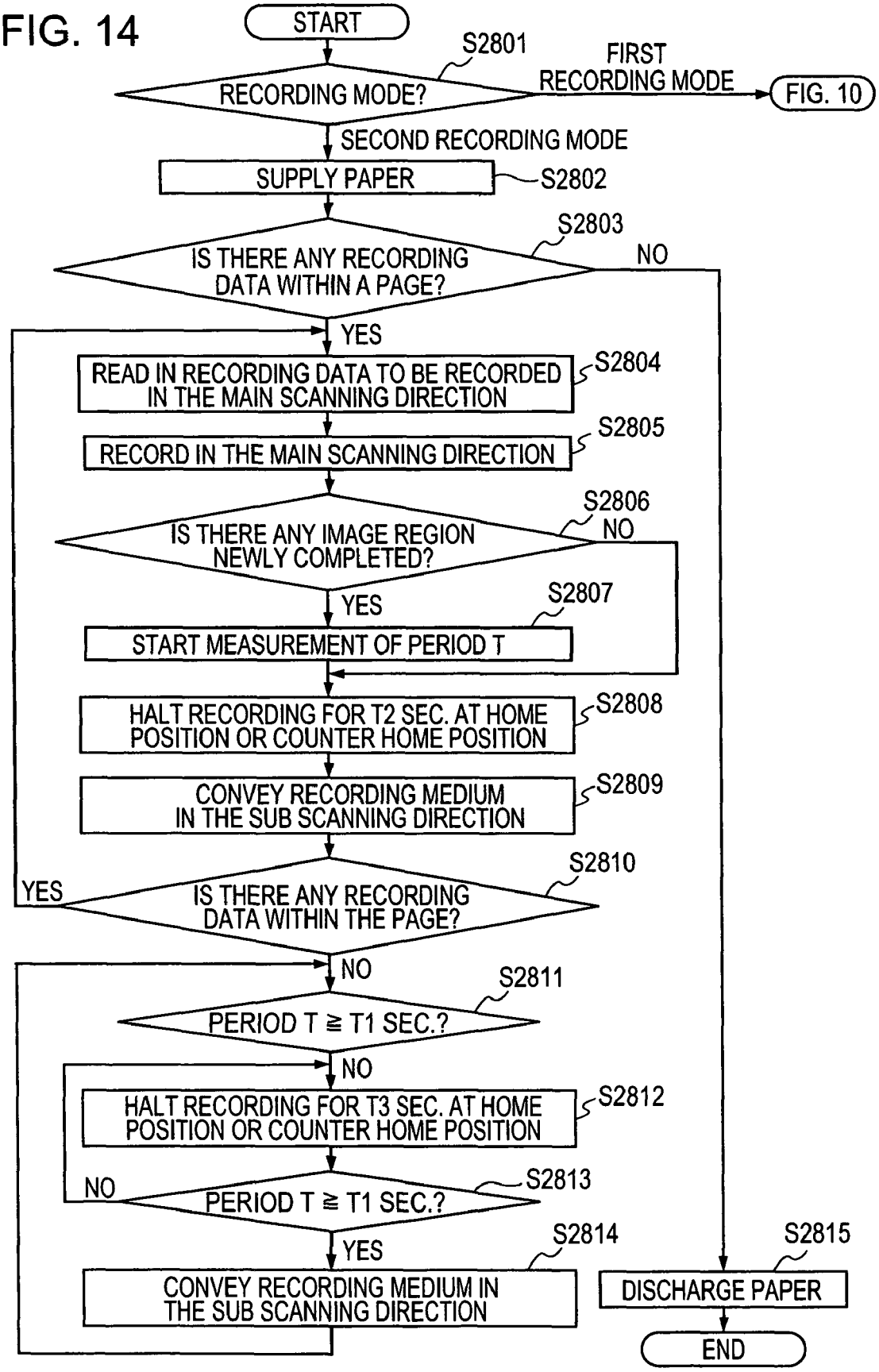
FIG. 14 is a flowchart for describing recording actions with the second example of the present invention.

FIG. 14 is a flowchart illustrating recording actions of the ink-jet recording apparatus according to the second example of the present invention.

In FIG. 14, a case wherein the image regions A1 through D2 shown in FIG. 11 are recorded will be described as an example.

First, in Step S2801, the type of recording mode is determined. In the event that the recording mode is the first recording mode 1, the recording actions in FIG. 10 with the first example are performed. On the other hand, in the event that the recording mode is the second recording mode, the flow proceeds to Step S2802.

Note that determination of the recording mode is performed based on recording setting information included in recording data to be received from the host computer, for example.

In Step S2802, paper feeding of the recording medium P is performed. In Step S2803, determination is made regarding whether or not recording data to be recorded exists within one page of the recording medium P. In the event of including no recording data (NO in Step S2802), the flow proceeds to Step S2815. On the other hand, in the event of including recording data (YES in Step S2802), the flow proceeds to Step S2804.

In this case, the image region A1-1 shown in FIG. 11 is recorded, so determination is made that there is recording data to be recorded within the page, and the flow proceeds to Step S2804.

In Step S2804, recording data to be recorded in the main scanning direction is read in. In this case, the recording data corresponding to the image region A1-1 is read in.

In Step S2805, recording is performed while moving the recording head in the outward main scanning direction. In the case of FIG. 12, recording of the image region A1-1 is performed at the first scan while moving the recording head 402 in the outward main scanning direction.

In Step S2806, determination is made regarding whether or not an image region of which recording is newly completed exists. In the event of including an image region of which recording is completed (YES in Step S2806), the flow proceeds to Step S2807. On the other hand, in the event of including no image region of which recording is completed (NO in Step S2806), the flow proceeds to Step S2808.

In this case, up to the image region A1-1 is recorded, and recording of the image region A1 is not completed, so determination is made that there is no image region of which recording is newly completed, and the flow proceeds to Step S2808.

In Step S2808, recording is halted at the counter home position for the predetermined T2 (2.4 sec in this case) as an intermission period.

In Step S2809, the recording medium P is conveyed by a predetermine amount ($^{128}/_{1200}$ inch in this case) in the sub scanning direction by the paper feed roller 403 and the paper discharge roller 404 (conveyance 1 of a recording medium).

In Step S2810, determination is made regarding whether or not recording data to be recorded exists within the page. In the event of including no recording data (NO in Step S2810), the flow proceeds to Step S2811. On the other hand, in the event of including recording data (YES in Step S2810), the flow returns to Step S2804.

In this case, the image regions A1-2 and A2-1 shown in FIG. 11 are recorded, so determination is made that there is recording data to be recorded within the page, and the flow returns to Step S2804.

As for recording actions as to the image regions A1-2 and A2-1, in Step S2804, recording data corresponding to the image regions A1-2 and A2-1 is read in. In Step S2805, recording of the image regions A1-2 and A2-1 is performed at the second scan in FIG. 12 while moving the recording head 402 in the homeward main scanning direction. Thus, recording of the image region A1 is completed.

Next, with the determination in Step S2806, recording of the image region A1 is completed, so determination is made that there is the image region of which recording is completed, the flow proceeds to Step S2807.

In Step S2807, measurement of the period T from twice-recording for completing the image region A1 ending is started. In Step S2808, recording is halted at the home position h for the predetermined period T2=2.4 sec as an intermission period. In Step S2809, the recording medium P is conveyed by a predetermined amount ($^{128}/_{1200}$ inch in this case) in the sub scanning direction by the paper feed roller 403 and the paper discharge roller 404.

With the determination in Step S2810, the image regions A2-2 and B1-1 shown in FIG. 11 are recorded, so determination is made that there is recording data to be recorded within the page, and the flow returns to Step S2804.

As for recording actions as to the image regions A2-2 and B1-1, in Step S2804, recording data corresponding to the image regions A2-2 and B1-1 is read in. In Step S2805, recording of the image regions A2-2 and B1-1 is performed at the third scan in FIG. 12 while moving the recording head 402 in the outward main scanning direction. Thus, recording of the image region A2 is completed.

Next, with the determination in Step S2806, recording of the image region A2 is completed, so determination is made that there is the image region of which recording is completed, the flow proceeds to Step S2807.

In Step S2807, the value of the period T is overwritten, and measurement of the period T from twice-recording for completing the image region A2 ending is started.

Also, at this point, the period Ta1 passed from completion of image region A1 becomes 2.6 sec obtained by aggregating the intermission period T2=2.4 sec at the home position h side following completion of homeward recording at the second scan, and 0.2 sec required for the outward main scanning at the third scan.

Next, in Step S2808, recording is halted at the counter home position for the predetermined period T2=2.4 sec as an intermission period. In Step S2809, the recording medium P is conveyed by a predetermined amount ($^{128}/_{1200}$ inch in this case) in the sub scanning direction by the paper feed roller 403 and the paper discharge roller 404.

Hereinafter, similarly, with Steps S2804 through S2810, recording actions as to the image regions B2-1 and B1-2 are performed. Recording of the image region B1 is completed by the recording actions as to the image regions B2-1 and B1-2, and in Step S2807, the period T is overwritten, and measurement of the period T from twice-recording for completing the image region B1 ending is started again.

Also, at this point, the period Ta1 from completion of the image region A1 becomes 5.2 sec obtained by aggregating the intermission period T2=2.4 sec on the home position h side following completion of homeward recording at the second scan, the intermission period T2=2.4 sec on the counter home position side following completion of outward recording at the third scan, 0.2 sec required for the outward main scanning at the third scan, and 0.2 sec required for the homeward main scanning at the fourth scan.

Also, at this point, the period Ta2 from completion of the image region A2 becomes 2.6 sec obtained by aggregating the intermission period T2=2.4 sec on the counter home position side following completion of outward recording at the third scan, and 0.2 sec required for the homeward main scanning at the fourth scan.

Next, with Steps S2804 through S2810, recording actions as to the image regions C1-1 and B2-2 are performed. Recording of the image region B2 is completed by the recording actions as to the image regions C1-1 and B2-2, and in Step S2807, the period T is overwritten, and measurement of the period T from twice-recording for completing the image region B2 ending is started again.

Also, at this point, the period Ta1 from completion of the image region A1 becomes 7.8 sec obtained by aggregating the intermission period T2=2.4 sec on the home position h side following completion of homeward recording at the second scan, the intermission period T2=2.4 sec on the counter home position side following completion of outward recording at the third scan, the intermission period T2=2.4 sec on the home position h side following completion of homeward recording at the fourth scan, 0.2 sec required for the outward main scanning at the third scan, 0.2 sec required for the homeward main scanning at the fourth scan, and 0.2 sec required for the outward main scanning at the fifth scan.

Also, at this point, the period Ta2 from completion of the image region A2 becomes 5.2 sec obtained by aggregating the intermission period T2=2.4 sec on the counter home position side following completion of outward recording at the third scan, the intermission period T2=2.4 sec on the home position h side following completion of homeward recording at the fourth scan, 0.2 sec required for the homeward main scanning at the fourth scan, and 0.2 sec required for the outward main scanning at the fifth scan.

Also, at this point, the period Tb1 from completion of the image region B1 becomes 2.6 sec obtained by aggregating the intermission period T2=2.4 sec on the home position h side following completion of homeward recording at the fourth scan, and 0.2 sec required for the outward main scanning at the fifth scan.

Hereinafter, similarly, Steps S2804 through S2810 are repeated until recording of the remaining image regions C1, C2, D1, and D2 is completed.

Hereinafter, the period Ta1 from completion of the image region A1 up to the image region A1 passing through the paper discharge roller 404 becomes a period from completion of recording of the image region A1 up to ending of a standby period at the home position following the homeward main scanning at the sixth scan. That is to say, the period Ta1 becomes 12.8 sec obtained by aggregating a period 10.4 sec from completion of the image region A1 up to end of the homeward scanning at the sixth scan, and the intermission period T2=2.4 sec on the home position h side following the homeward scanning at the sixth scan.

Similarly, the period Ta2 from completion of the image region A2 up to the image region A2 passing through the paper discharge roller 404 becomes an aggregation of a period from completion of recording of the image region A2 up to ending of the outward scanning at the seventh scan, and a standby period following the seventh scan. That is to say, the period Ta2 becomes 12.8 sec obtained by aggregating a period 10.4 sec from completion of the image region A2 up to end of the outward scanning at the seventh scan, and the intermission period T2=2.4 sec on the counter home position side following the outward scanning at the seventh scan.

Similarly, the period Tb1 from completion of the image region B1 up to the image region B1 passing through the paper discharge roller 404 becomes an aggregation of a period from completion of recording of the image region B1 up to ending of the homeward scanning at the eighth scan, and an intermission period following the eighth scan. That is to say, the period Tb1 becomes 12.8 sec obtained by aggregating a period 10.4 sec from completion of the image region B1 up to end of the eighth scan, and the intermission period T2=2.4 sec on the home position h side following the homeward scanning at the eighth scan.

Similarly, the period Tb2 from completion of the image region B2 up to the image region B2 passing through the paper discharge roller 404 becomes an aggregation of a period from completion of recording of the image region B2 up to end of the outward scanning at the ninth scan, and an intermission period on the counter home position side following the ninth scan. That is to say, the period Tb2 becomes 12.8 sec obtained by aggregating a period 10.4 sec from completion of the image region B2 up to end of the outward scanning at the ninth scan, and the intermission period T2=2.4 sec on the counter home position side following recording at the ninth outward scanning.

Upon recording of the image region D2 being completed, with the determination in Step S2810, no image region to be recorded exists on the side closer to the paper discharging side than the image region D2, so determination is made that there is no recording data to be recorded within the page, and the flow proceeds to Step S2811.

In Step S2811, determination is made regarding whether or not the period T from completion of the image region C1 is the predetermined period T1 (10.6 sec in this case) or more. In the event that the period T is the predetermined period T1 or more (YES in Step S2811), the flow proceeds to Step S2815. On the other hand, in the event that the period T is less than the predetermined period T1 (NO in Step S2811), the flow proceeds to Step S2812.

In this case, the period Tc1 from completion of the image region C1 is 10.2 sec, so is less than the predetermined period T1 (=10.6 sec), and the flow proceeds to Step S2812.

At this point, the period Tc2 from completion of the image region C2 is 7.6 sec. Also, at this point, the period Td1 from completion of the image region D1 is 5.0 sec. Also, at this point, the period Td2 from completion of the image region D2 is 2.4 sec.

In Step. S2812, recording is halted at the counter home position for a predetermined period T3 (2.7 sec in this case) as an intermission period.

In Step S2813, determination is made regarding whether or not the period T from completion of the image region C1 is the predetermined period T1 (=10.6 sec) or more. In the event that the period T is the predetermined period T1 or more (YES in Step S2813), the flow proceeds to Step S2814. On the other hand, in the event that the period T is less than the predetermined period T1 (NO in Step S2813), the flow returns to Step S2812.

At this point, the period Tc1 from completion of the image region C1 is measured as 12.9 sec obtained by aggregating the above 10.2 sec, and the intermission period T3=2.7 sec on the home position h side, so is determined to be equal to or greater than the predetermined period T1 (=10.6 sec).

Also, at this point, the period Tc2 from completion of the image region C2 becomes 10.3 sec obtained by aggregating the above 7.6 sec, and the intermission period T3=2.7 sec on the home position h side.

Also, at this point, the period Td1 from completion of the image region D1 becomes 7.7 sec obtained by aggregating the above 5.0 sec, and the intermission period T3=2.7 sec on the home position h side.

Also, at this point, the period Td2 from completion of the image region D2 becomes 5.1 sec obtained by aggregating the above 2.4 sec, and the intermission period T3=2.7 sec on the home position h side.

In Step S2814, the recording medium P is conveyed by a predetermined amount ($^{100}/_{1200}$ inch in this case) in the sub scanning direction by the paper feed roller 403 and the paper discharge roller 404 (conveyance 2 of a recording medium).

In Step S2811, determination is made again regarding whether or not the period T from completion of the image region C2 is the predetermined period T1 (10.6 sec in this case) or more.

At this point, the period Tc2 from completion of the image region C2 is 10.3 sec, so is less than the predetermined period T1 (=10.6 sec), and the flow proceeds to Step S2812.

In Step S2812, recording is halted at the home position h for the predetermined period T3=2.7 sec as an intermission period.

In Step S2813, determination is made regarding whether or not the period T from completion of the image region C2 is the predetermined period T1 (=10.6 sec) or more.

At this point, the period Tc2 from completion of the image region C2 is measured as 13.0 sec obtained by aggregating the above 10.3 sec, and the intermission period T3=2.7 sec on the home position h side, so is determined to be equal to or greater than the predetermined period T1 (=10.6 sec).

Also, at this point, the period Td1 from completion of the image region D1 becomes 10.4 sec obtained by aggregating the above 7.7 sec, and the intermission period T3=2.7 sec on the home position h side.

Also, at this point, the period Td2 from completion of the image region D2 becomes 7.8 sec obtained by aggregating the above 5.1 sec, and the intermission period T3=2.7 sec on the home position h side.

In Step S2814, the recording medium P is conveyed by a predetermined amount (100/1200 inch in this case) in the sub scanning direction by the paper feed roller 403 and the paper discharge roller 404 (conveyance 3 of a recording medium).

In Step S2811, determination is made again regarding whether or not the period T from completion of the image region D1 is the predetermined period T1 (=10.6 sec) or more.

At this point, the period Td1 from completion of the image region D1 is 10.4 sec, so is less than the predetermined period T1 (=10.6 sec), and the flow proceeds to Step S2812.

In Step S2812, recording is halted at the home position h for the predetermined period T3=2.7 sec as an intermission period.

In Step S2813, determination is made regarding whether or not the period T from completion of the image region D1 is the predetermined period T1 (=10.6 sec) or more.

At this point, the period Td1 from completion of the image region D1 is measured as 13.1 sec obtained by aggregating the above 10.4 sec, and the intermission period T3=2.7 sec on the home position h side, so is determined to be equal to or greater than the predetermined period T1 (=10.6 sec).

Also, at this point, the period Td2 from completion of the image region D2 becomes 10.5 sec obtained by aggregating the above 7.8 sec, and the intermission period T3=2.7 sec on the home position h side.

In Step S2814, the recording medium P is conveyed by a predetermined amount (100/1200 inch in this case) in the sub scanning direction by the paper feed roller 403 and the paper discharge roller 404 (conveyance 4 of a recording medium).

In Step S2811, determination is made again regarding whether or not the period T from completion of the image region D2 is the predetermined period T1 (=10.6 sec) or more.

At this point, the period Td2 from completion of the image region D2 is 10.5 sec, so is less than the predetermined period T1 (=10.6 sec), and the flow proceeds to Step S2812.

In Step S2812, recording is halted at the counter home position for the predetermined period T3=2.7 sec as an intermission period.

In Step S2813, determination is made regarding whether or not the period T from completion of the image region D2 is the predetermined period T1 (=10.6 sec) or more.

At this point, the period Td2 from completion of the image region D2 is measured as 13.2 sec obtained by aggregating the above 10.5 sec, and the intermission period T3=2.7 sec on the counter home position side, so is determined to be equal to or greater than the predetermined period T1 (=10.6 sec).

In Step S2814, the recording medium P is conveyed by a predetermined amount (100/1200 inch in this case) in the sub scanning direction by the paper feed roller 403 and the paper discharge roller 404 (conveyance 5 of a recording medium).

In Step S2811, determination is made again regarding whether or not the period T from completion of the image region D2 is the predetermined period T1 (=10.6 sec) or more.

At this point, the period Td2 from completion of the image region D2 is 13.2 sec, so is equal to or greater than the predetermined period T1 (=10.6 sec), and the flow proceeds to Step S2815, where the recording medium P is discharged.

As described above, according to the second example, in the second recording mode, with the main scanning direction, the width X1 in the main scanning direction of the image region of which the recording width in the main scanning direction is the shortest of all of the image regions to be recorded on the recording surface of the recording medium P becomes 4 inches in the case of FIG. 11.

FIG. 11 illustrates the multiple image regions A1 through D2 divided in the sub scanning direction. These image regions A1 trough D2 corresponds to an image region W1. The paper discharge roller 404, which conveys the recording medium P while coming into contact with the recording surface of the recording medium P, is disposed on the side closer to the paper discharging side than the recording head 402. The width between the ink discharge orifice closest to the paper discharging side of the ink discharge orifices employed for recording of the image regions A1 through D2, and the paper discharge roller 404 becomes 256/1200 (inch)×3 (number of scanning), i.e., 768/1200 (inch). The width Y1 obtained by subtracting 256/1200 (inch) serving as the width of the ink discharge orifice employed for recording from that width, 768/1200 (inch) becomes 512/1200 (inch).

An image region W2 defined by the width X1 and the width Y1 becomes the same size as an image region obtained by combining four of the image region A1, image region A2, image region B1, and image region B2.

Thus, the period T1 necessary for completing the image region obtained by combining four of the image region A1, image region A2, image region B1, and image region B2 with the second example becomes 10.6 sec obtained by aggregating 0.2 sec required for the outward main scanning at the first scan, the intermission period T2=2.4 sec between the outward main scanning direction at the first scan and the homeward main scanning direction at the second scan, 0.2 sec required for the homeward main scanning at the second scan, the intermission period T2=2.4 sec between the homeward main scanning direction at the second scan and the outward main scanning direction at the third scan, 0.2 sec required for the outward main scanning at the third scan, the intermission period T2=2.4 sec between the outward main scanning direction at the third scan and the homeward main scanning direction at the fourth scan, 0.2 sec required for the homeward main scanning at the fourth scan, the intermission period T2=2.4 sec between the homeward main scanning direction at the fourth scan and the outward main scanning direction at the fifth scan, and 0.2 sec required for the outward main scanning at the fifth scan.

The period necessary for coming into contact with the paper discharge roller 404 from completion of the image region to be recorded on the recording surface of the recording medium P with the second example is after the elapsing of 12.8 sec regarding the image regions A1 through B2, and after the elapsing of 12.9 sec regarding the image region C1. Also, the image region C2 comes into contact after the elapsing of 13.0 sec, the image region D1 comes into contact after the elapsing of 13.1 sec, and the image region D2 comes into contact after the elapsing of 13.2 sec. Thus, all of the image regions A1 through D2 result in coming into contact with the paper discharge roller 404 after the elapsing of the predetermined period T1 (=10.6 sec). That is to say, as can be understood from the table in FIG. 9, even in a case wherein poor fixing of ink to the recording medium P, a recording image and the paper discharge roller 404 can be prevented from contamination.

The Sub scanning for conveying the recording medium P is repeated as to a region including no recording data closer to the paper supplying side than the image region with the second example for (1/3)×T1, i.e., around 3.5 sec or more from completion of the image region D up to the elapsing of around 13.2 sec. At this time, the sub scanning of the conveyance 1 of recording media through the conveyance 5 of recording media, five times in a row, is performed, as shown in FIG. 12. Thus, the user can be informed that recording actions have not been completed as to the regions having no recording data closer to the paper supplying side than the image regions by performing the sub scanning following completion of recording of the image region D2.

For example, it can be assumed that the user determines that recording actions have been completed, and extracts the recording media remaining within the recording apparatus before the recording images on the recording media are sufficiently permeated and fixed. As described above, scanning of the recording head and conveyance of the recording medium are performed for a predetermined period as to the region having no recording data, thereby preventing the user from accidentally extracting recording media from the apparatus.

In addition, providing an intermission period between the ninth main scanning which completes the image region D2 and the sub scanning of the conveyance 1 of the recording medium, and between each of the sub scanning of the conveyance 1 through the sub scanning of the conveyance 5 can yield a period of 13.2 sec from completion of the image region D2. This period becomes a period of (1/3)×T1, i.e., around 3.5 sec or more. Also, even at the time of paper discharging, the same sub scanning actions for scanning the recording medium P are thus repeatedly performed. Thus configured, as can be understood from the table in FIG. 9, even in the event that fixing of ink to the recording medium P is poor, contamination of recording images and the paper discharge roller 404 can be prevented. In addition, employing the paper discharge roller 404 having appropriate conveyance precision in the sub scanning direction of the recording medium P can improve the image quality of the recording image on the recording medium P.

With the second example, description has been made regarding the two-types of recording modes of which the number of scanning for completing an image is different. As for the recording modes, the first recording mode for completing an image with the once-main scanning in the outward direction of the recording head, and the second recording mode for completing an image with the outward and homeward scanning of the recording head are employed. Note that the first recording mode is the recording action described with the first example. Also note that the present invention is not restricted to the recording modes of which the number of scanning for completing an image is different, as described above. For example, the same control may be applied to various types of recording modes such as recording modes of which the scanning speed in the main scanning direction is different, or recording modes of which the scanning speed in the sub scanning direction is different, or the like.

Also, with the second example, description has been made regarding the case wherein all of the image regions to be recorded on the recording surface of the recording medium P have 100% recording duty as an example. However, the present invention is not restricted to this configuration, and even if an image region has recording duty less than 100%, the same advantages can be obtained by performing the same control.

Third Example

With a third example, description will be made regarding a case wherein the image regions A through D according to the first example have different recording duty. Here, the same recording head 402 as with the first example is employed as an example.

Figure 15:
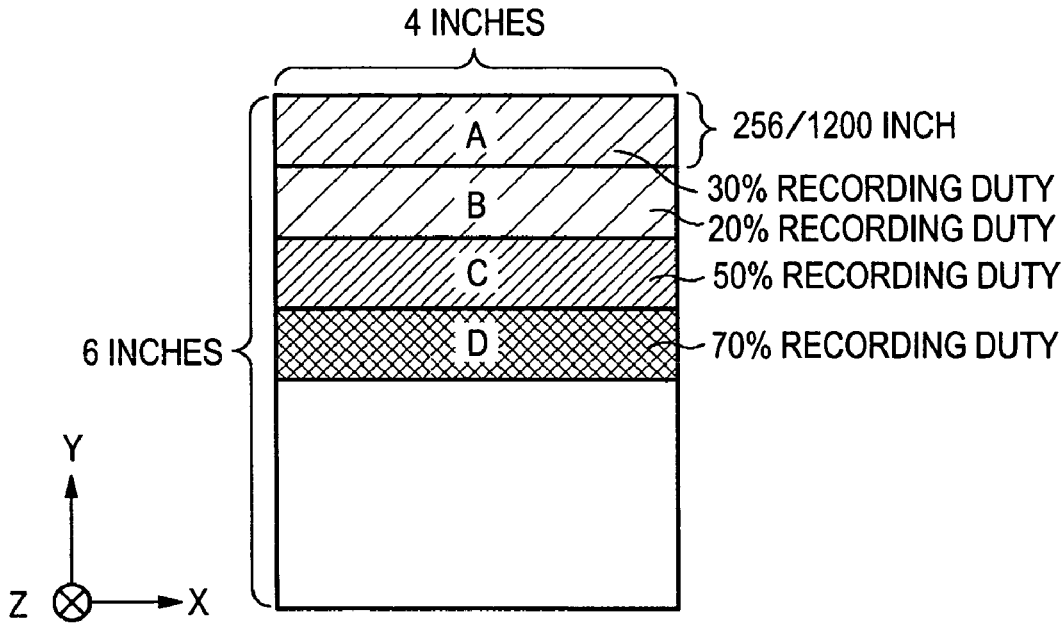
FIG. 15 is a diagram illustrating a recording image with a third example of the present invention.

With the third example, description will be made, for example, regarding the case of simplex recording wherein the respective image regions in FIG. 15 are completed in the outward main scanning direction, and an intermission period is provided between the outward main scanning and the homeward main scanning with reference to FIGS. 7, 8, 9, 10, 15, 19, 20, and 21.

First, description will be made regarding an example of a recording image according to the third example with reference to FIG. 15. FIG. 15 is a diagram illustrating the recording image according to the third embodiment of the present invention.

In FIG. 15, for example, an example of glossy paper having a 4×6 inch size is illustrated as the recording medium P. Also, a recording image to be recorded on this recording medium P has a $^{256}/_{1200}$×4 inch size wherein recording duty of an image region A is 30%, recording duty of an image region B is 20%, recording duty of an image region C is 50%, and recording duty of an image region D is 70%.

Figure 16:
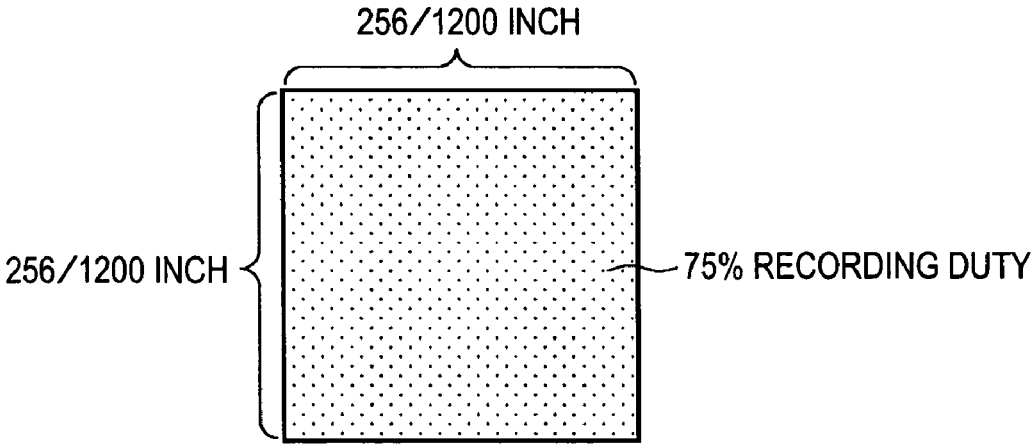
FIG. 16 is a diagram illustrating a patch described in the third example of the present invention.
Figures 17, 18:
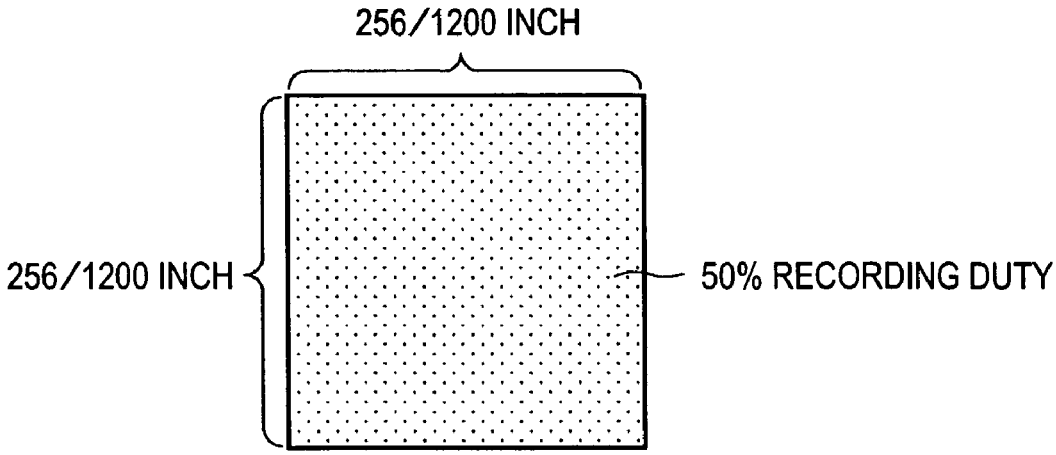
FIG. 17 is a diagram illustrating evaluation results of a period up to passing through a paper discharge roller, and contamination levels of the paper discharge roller and a recording surface described in the third example of the present invention.
FIG. 18 is a diagram illustrating a patch with the third example of the present invention.

FIG. 16 is a diagram illustrating a patch of which recording duty is 75%, and size is $^{256}/_{1200}$ inch square. FIG. 17 is a table illustrating the relations between a period from completion of the image in FIG. 16 up to passing through the paper discharge roller 404, and a contamination level of the paper discharge roller 404 and a contamination transfer level to the recording surface of the recording medium P from the contaminated paper discharge roller 404.

The table in FIG. 17 is evaluation results obtained by changing a period from completion of the image in FIG. 12 up to passing through the paper discharge roller 404, such as 0.4 sec, 3.6 sec, 7.6 sec, 10.6 sec, and 13.6 sec, and evaluating a contamination level of the paper discharge roller 404 and the recording surface of the recording medium P at that time.

0.4 sec at this time is a case wherein paper discharging of the recording medium P is performed by repeating scanning in the sub scanning direction alone.

It has been found from the evaluation results that in the event that a period from completion of the image in FIG. 16 up to passing through the paper discharge roller 404 is 7.6 or more, contamination as to the paper discharge roller 404 and the recording surface of the recording medium P does not occur.

FIG. 18 is a diagram illustrating a patch of which recording duty is 50%, and size is $^{256}/_{1200}$ inch square. FIG. 19 is a table illustrating the relations between a period from completion of the image in FIG. 18 up to passing through the paper discharge roller 404, and a contamination level of the paper discharge roller 404 and a contamination transfer level to the recording surface of the recording medium P from the contaminated paper discharge roller 404.

The table in FIG. 19 is evaluation results obtained by changing a period from completion of the image in FIG. 18 up to passing through the paper discharge roller 404, such as 0.4 sec, 3.6 sec, 7.6 sec, 10.6 sec, and 13.6 sec, and evaluating a contamination level of the paper discharge roller 404 and the recording surface of the recording medium P at that time.

0.4 sec at this time is a case wherein paper discharging of the recording medium P is performed by repeating scanning in the sub scanning direction alone.

It has been found from the evaluation results that in the event that a period from completion of the image in FIG. 18 up to passing through the paper discharge roller 404 is 3.6 or more, contamination as to the paper discharge roller 404 and the recording surface of the recording medium P does not occur.

FIG. 20 is a table illustrating classification of dot count levels according to the number of dots within (256 dots/1200 dpi)×(256 dots/1200 dpi). The dot count levels are classified into three of 0 through 2.

The dot count level 0 shows that recording duty within (256 dots/1200 dpi)×(256 dots/1200 dpi) is equal to or less than 50%. The dot count level 1 shows that recording duty within (256 dots/1200 dpi)×(256 dots/1200 dpi) is equal to or greater than 50% but less than 75%. The dot count level 2 shows that recording duty within (256 dots/1200 dpi)×(256 dots/1200 dpi) is equal to or greater than 75%.

Figures 21, 22:
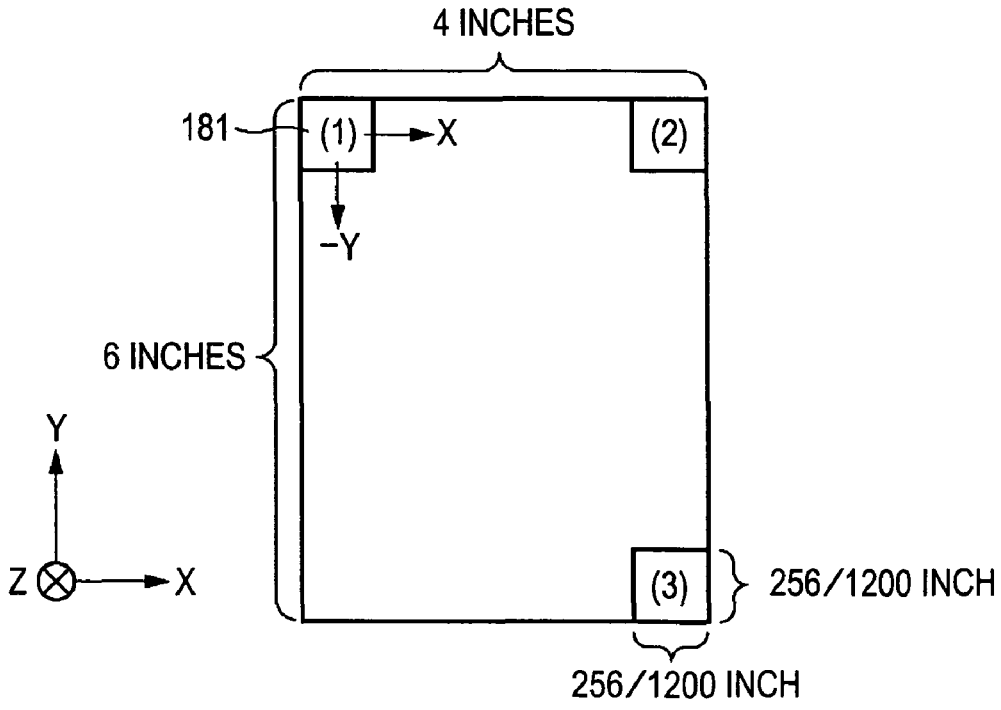
FIG. 21 is a diagram illustrating a period from recording up to passing through the paper discharge roller depending on a dot count level with the third example of the present invention.
FIG. 22 is a diagram illustrating the movement position of a window for counting the number of recording dots with the third example of the present invention.

FIG. 21 is a table illustrating the relation between the dot count level set in FIG. 20 and a period from completion of recording of an image up to passing through the paper discharge roller 404. Here, the period from completion of recording of an image up to passing through the paper discharge roller 404 is set based on the results of FIGS. 17 and 19.

FIG. 22 is a diagram illustrating the movement position of a window 181 having a (256 dots/1200 dpi)×(256 dots/1200 dpi) size for counting the number of recording dots within the window 181 regarding all regions of the 4×6 inch recording medium.

First, the window 181 is moved in the X direction by 1 pixel/1200 dpi from a position (1).

Next, upon the window 181 being moved to a position (2), the window 181 is moved by 1 pixel/1200 dpi in the X direction from a position obtained by shifting the position (1) by 1 pixel/1200 dpi in the −Y direction.

Similarly, the window 181 is moved while shifting the position thereof by vertically 1 pixel/1200 dpi and horizontally 1 pixel/1200 dpi, and movement of the window 181 is ended at a position (3).

Next, description will be made regarding recording actions of an ink-jet recording apparatus according to the third example with reference to FIG. 23.

Figure 23:
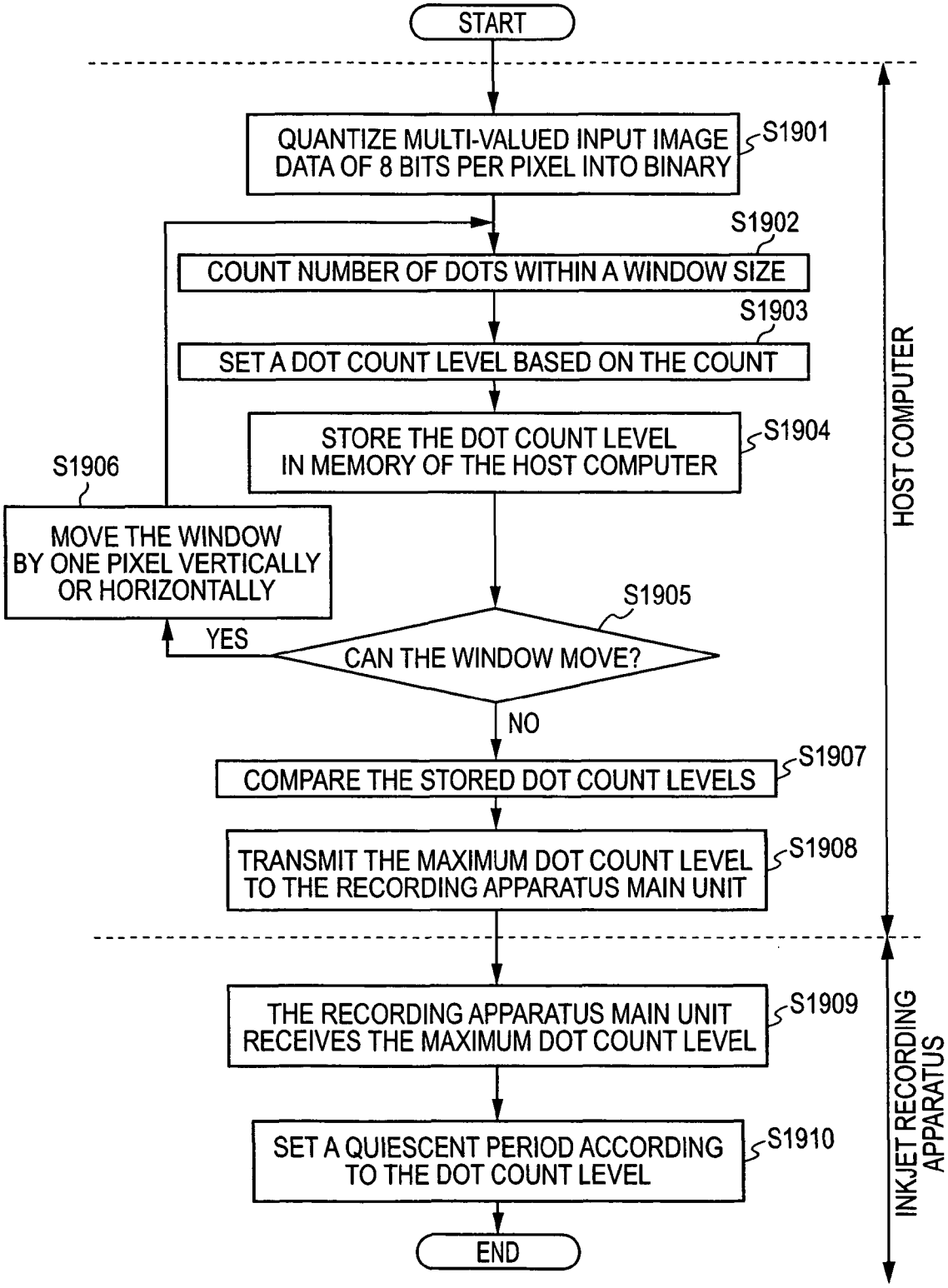
FIG. 23 is a flowchart illustrating recording actions with the third example of the present invention.

FIG. 23 is a flowchart illustrating recording actions of the ink-jet recording apparatus according to the third example of the present invention. In FIG. 23, description will be made regarding recording actions between the ink-jet recording apparatus and the host computer which supplies recording data thereto. In particular, the processing in Steps S1901 through S1908 is processing on the host computer side, and the processing in Steps S1909 and S1910 is processing on the ink-jet recording apparatus side.

In Step S1901, multi-valued input image data is quantized to binary by a printer driver within the host computer. Here, for example, multi-valued input image data of 8 bits per 1 pixel/1200 dpi is quantized to binary.

In Step S1902, the number of dots within the window size of image data to be processed is counted.

First, the number of dots within the window size at the position (1) in FIG. 22 regarding the quantization image data corresponding to the image region A of the image in FIG. 15 of which recording duty is 30%.

In Step S1903, a dot count level is set based on the count value (number of dots). In this case, the count value is in the case wherein recording duty is 30%, so the dot count level is set to 0 reference to the table in FIG. 20.

In Step S1904, the dot count level is stored in the memory of the host computer. In this case, 0 is stored as a dot count level.

In Step S1905, determination is made regarding whether or not the window (e.g., window 181 in FIG. 18) can be moved. In the event that the window cannot be moved (NO in Step S1905), the flow proceeds to Step S1907. In the event that the window can be moved (YES in Step S1905), the flow proceeds to Step S1906, where the window is moved by vertically or horizontally one pixel.

In the case of the example in FIG. 18, determination is made regarding whether or not the window 181 can be moved from the position (1), and in Step S1906, the window 181 is moved by 1 pixel/1200 dpi in the X direction from the position (1). The processing in Steps S1902 through S1906 is repeated until the window 181 is moved to the position (3). Thereafter, when the window 181 reaches the position (3), determination is made that the window 181 cannot be moved, and the flow proceeds to Step S1907.

In Step S1907, the dot count levels stored in the memory of the host computer are compared for each window size.

In this case, the dot count level 1 set by the number of dots (recording duty is 70%) of the image region D in FIG. 15 is the maximum dot count level.

In Step S1908, the maximum dot count level (1 in this case), of the compared dot count levels, is transmitted to the ink-jet recording apparatus main unit.

In Step S1909, the ink-jet recording apparatus receives the maximum dot count level (1 in this case) from the host computer.

In Step S1910, an intermission period is set based on the received maximum dot count level.

In this case, the maximum dot count level is 1, so that an intermission period is set at 7 sec. with reference to the table in FIG. 21 such that a period from completion of recording up to passing through the paper discharge roller 404 becomes 7.6 sec.

Description will be made regarding subsequent recording actions of the ink-jet recording apparatus with reference to FIG. 10.

First, in Step S1001, the recording medium P is supplied. In Step S1002, the image region A shown in FIG. 15 is recorded, so determination is made that there is recording data to be recorded within the page, the flow proceeds to Step S1003. In Step S1003, the recording data corresponding to the image region A is read in.

In Step S1004, recording of the image region A is performed at the first scan in FIG. 7 while moving the recording head 402 in the outward main scanning direction. In Step S1005, measurement of the period T from completion of recording is started. In Step S1006, recording is halted at the counter home position for the predetermined period T2 (7 sec in this case) as an intermission period.

In Step S1007, following the halt, the recording head 402 is moved in the homeward main scanning direction at the second scan in FIG. 7. In Step S1008, upon the recording head 402 returning to the home position h side, the recording medium P is conveyed by a predetermined amount ($^{256}/_{1200}$ inch in this case) in the sub scanning direction by the paper feed roller 403 and the paper discharge roller 404.

Up to now, the period T has been measured as 7.2 sec obtained by aggregating the intermission period T2=7 sec between the outward main scanning at the first scan and the homeward main scanning at the second scan, and 0.2 sec required for the homeward main scanning at the second scan.

Next, with determination in Step S1009, the recording region B in FIG. 15 is recorded, so determination is made that there is recording data to be recorded within the page, and the flow returns to Step S1003.

As for recording actions as to the image region B, in Step S1003, the recording data corresponding to the image region B is read in. In Step S1004, recording of the image region B is performed at the third scan in FIG. 7 while moving the recording head 402 in the outward main scanning direction. Next, in Step S1005, the value of the period T is overwritten, measurement of the period T from completion of recording at the third scan is started again.

In Step S1006, recording is halted at the counter home position for the predetermined period T2=7 sec as an intermission period. In Step S1007, following the halt, the recording head 402 is moved in the homeward main scanning direction at the fourth scan in FIG. 7. In Step S1008, upon the recording head 402 returning to the home position h side, the recording medium P is conveyed by a predetermined amount ($^{256}/_{1200}$ inch in this case) in the sub scanning direction by the paper feed roller 403 and the paper discharge roller 404.

Up to now, the period T has been measured as 7.2 sec obtained by aggregating the intermission period T2=7 sec between the outward main scanning at the third scan and the homeward main scanning at the fourth scan, and 0.2 sec required for the homeward main scanning at the fourth scan.

Also, at this point, a period Ta from completion of the image region A becomes 14.6 sec obtained by aggregating the intermission period T2=7 sec between the outward main scanning direction at the first scan and the homeward main scanning direction at the second scan, the intermission period T2=7 sec between the outward main scanning direction at the third scan and the homeward main scanning direction at the fourth scan, 0.2 sec required for the homeward main scanning at the second scan, 0.2 sec required for the outward main scanning at the third scan, and 0.2 sec required for the homeward main scanning at the fourth scan.

Next, with the determination in Step S1009, the image region C shown in FIG. 15 is recorded, so determination is made that recording data to be recorded exists within the page, and the flow returns to Step S1003.

As for recording actions as to the image region C, in Step S1003, the recording data corresponding to the image region C is read in. In Step S1004, recording of the image region C is performed at the fifth scan in FIG. 7 while moving the recording head 402 in the outward main scanning direction. Next, in Step S1005, the period T is overwritten, and measurement of the period T passed from completion of recording at the fifth scan is started again.

In Step S1006, as an intermission period, recording is halted at the counter home position for the predetermined period T2=7 sec. In Step S1007, following the halt, the recording head 402 is moved in the homeward main scanning direction at the sixth scan in FIG. 7. In Step S1008, upon the recording head 402 returning to the home position h, the recording medium P is conveyed by a predetermined length ($^{256}/_{1200}$ inch in this case) in the sub scanning direction by the paper feed roller 403 and the paper discharge roller 404.

Up to now, the period T has been measured as 7.2 sec obtained by aggregating the intermission period T2=7 sec between the outward main scanning direction at the fifth scan and the homeward main scanning direction at the sixth scan, and 0.2 sec required for the homeward main scanning at the sixth scan.

Also, at this point, the period Ta from completion of the image region A becomes 22 sec obtained by aggregating the intermission period T2=7 sec between the outward main scanning direction at the first scan and the homeward main scanning direction at the second scan, the intermission period T2=7 sec between the outward main scanning direction at the third scan and the homeward main scanning direction at the fourth scan, the intermission period T2=7 sec between the outward main scanning direction at the fifth scan and the homeward main scanning direction at the sixth scan, 0.2 sec required for the homeward main scanning at the second scan, 0.2 sec required for the outward main scanning at the third scan, 0.2 sec required for the homeward main scanning at the fourth scan, 0.2 sec required for the outward main scanning at the fifth scan, and 0.2 sec required for the homeward main scanning at the sixth scan.

Also, at this point, a period Tb from completion of the image region B becomes 14.6 sec obtained by aggregating the intermission period T2=7 sec between the outward main scanning direction at the third scan and the homeward main scanning direction at the fourth scan, the intermission period T2=7 sec between the outward main scanning direction at the fifth scan and the homeward main scanning direction at the sixth scan, 0.2 sec required for the homeward main scanning at the fourth scan, 0.2 sec required for the outward main scanning at the fifth scan, and 0.2 sec required for the homeward main scanning at the sixth scan.

Next, with the determination in Step S1009, the image region D shown in FIG. 15 is recorded, so determination is made that recording data to be recorded exists within the page, and the flow returns to Step S1003.

As for recording actions as to the image region D, in Step S1003, the recording data corresponding to the image region D is read in. In Step S1004, recording of the image region D is performed at the seventh scan in FIG. 7 while moving the recording head 402 in the outward main scanning direction. Next, in Step S1005, the value of the period T is overwritten, and measurement of the period T from completion of recording at the seventh scan is started again.

In Step S1006, as an intermission period, recording is halted at the counter home position for the predetermined period T2=7 sec. In Step S1007, following the halt, the recording head 402 is moved in the homeward main scanning direction at the eighth scan in FIG. 7. In Step S1008, the recording medium P is conveyed by a predetermined length ($^{256}/_{1200}$ inch in this case) in the sub scanning direction by the paper feed roller 403 and the paper discharge roller 404.

Up to now, the period T has been measured as 7.2 sec obtained by aggregating the intermission period T2=7 sec between the outward main scanning direction at the seventh scan and the homeward main scanning direction at the eighth scan, and 0.2 sec required for the homeward main scanning at the eighth scan.

Also, at this point, the period Tb from completion of the image region B becomes 22 sec obtained by aggregating the intermission period T2=7 sec between the outward main scanning direction at the third scan and the homeward main scanning direction at the fourth scan, the intermission period T2=7 sec between the outward main scanning direction at the fifth scan and the homeward main scanning direction at the sixth scan, the intermission period T2=7 sec between the outward main scanning direction at the seventh scan and the homeward main scanning direction at the eighth scan, 0.2 sec required for the homeward main scanning at the fourth scan, 0.2 sec required for the outward main scanning at the fifth scan, 0.2 sec required for the homeward main scanning at the sixth scan, 0.2 sec required for the outward main scanning at the seventh scan, and 0.2 sec required for the homeward main scanning at the eighth scan.

Also, at this point, a period Tc from completion of the image region C becomes 14.6 sec obtained by aggregating the intermission period T2=7 sec between the outward main scanning direction at the fifth scan and the homeward main scanning direction at the sixth scan, the intermission period T2=7 sec between the outward main scanning direction at the seventh scan and the homeward main scanning direction at the eighth scan, 0.2 sec required for the homeward main scanning at the sixth scan, 0.2 sec required for the outward main scanning at the seventh scan, and 0.2 sec required for the homeward main scanning at the eighth scan.

Also, at this point, the period Ta from completion of the image region A becomes 29.4 sec obtained by aggregating the intermission period T2=7 sec between the outward main scanning direction at the first scan and the homeward main scanning direction at the second scan, the intermission period T2=7 sec between the outward main scanning direction at the third scan and the homeward main scanning direction at the fourth scan, the intermission period T2=7 sec between the outward main scanning direction at the fifth scan and the homeward main scanning direction at the sixth scan, the intermission period T2=7 sec between the outward main scanning direction at the seventh scan and the homeward main scanning direction at the eighth scan, 0.2 sec required for the homeward main scanning at the second scan, 0.2 sec required for the outward main scanning at the third scan, 0.2 sec required for the homeward main scanning at the fourth scan, 0.2 sec required for the outward main scanning at the fifth scan, 0.2 sec required for the homeward main scanning at the sixth scan, 0.2 sec required for the outward main scanning at the seventh scan, and 0.2 sec required for the homeward main scanning at the eighth scan. That is to say, the recording medium P is passes through the paper discharge roller 404 after the elapsing of 29.4 sec from completion of recording of the image region A.

Next, with the determination in Step S1009, determination is made that no recording data to be recorded exists within the page since no image region to be recorded exists on the side closer to the paper discharging side than the image region D shown in FIG. 15, and the flow proceeds to Step S1010.

In Step S1010, determination is made regarding whether or not the period T from completion of the image region D is a predetermined period T1 (7.6 sec in this case) or more.

In this case, the period T from completion of the image region D is 7.2 sec, so is less than the predetermined period T1 (=7.6 sec), and the flow proceeds to Step S1011.

In Step S1011, the recording head 402 is moved in the outward main scanning direction at the ninth scan in FIG. 7. In Step S1012, as an intermission period, recording is halted at the counter home position for the predetermined period T2=7 sec. In Step S1013, following the halt, the recording head 402 is moved in the homeward main scanning direction at the tenth scan in FIG. 7.

In Step S1014, upon the recording head 402 returning to the home position h side, the recording medium P is conveyed by a predetermined amount ($^{256}/_{1200}$ inch in this case) in the sub scanning direction by the paper feed roller 403 and the paper discharge roller 404.

In Step S1010, determination is made again regarding whether or not the period T from completion of the image region D is the predetermined period T1 (=7.6 sec) or more.

At this time, the period T becomes 14.6 sec obtained by aggregating the intermission period T2=7 sec between the outward main scanning direction at the seventh scan and the homeward main scanning direction at the eighth scan, the intermission period T2=7 sec between the outward main scanning direction at the ninth scan and the homeward main scanning direction at the tenth scan, 0.2 sec required for the homeward main scanning at the eighth scan, 0.2 sec required for the outward main scanning at the ninth scan, and 0.2 sec required for the homeward main scanning at the tenth scan.

Also, at this point, the period Tb from completion of the image region B becomes 29.4 sec obtained by aggregating the intermission period T2=7 sec between the outward main scanning direction at the third scan and the homeward main scanning direction at the fourth scan, the intermission period T2=7 sec between the outward main scanning direction at the fifth scan and the homeward main scanning direction at the sixth scan, the intermission period T2=7 sec between the outward main scanning direction at the seventh scan and the homeward main scanning direction at the eighth scan, the intermission period T2=7 sec between the outward main scanning direction at the ninth scan and the homeward main scanning direction at the tenth scan, 0.2 sec required for the homeward main scanning at the fourth scan, 0.2 sec required for the outward main scanning at the fifth scan, 0.2 sec required for the homeward main scanning at the sixth scan, 0.2 sec required for the outward main scanning at the seventh scan, 0.2 sec required for the homeward main scanning at the eighth scan, 0.2 sec required for the outward main scanning at the ninth scan, and 0.2 sec required for the homeward main scanning at the tenth scan. That is to say, following recording of the image region B being completed, the recording medium P passes through the paper discharge roller 404 after the elapsing of 29.4 sec.

Also, at this point, the period Tc from completion of the image region C becomes 22 sec obtained by aggregating the intermission period T2=7 sec between the outward main scanning direction at the fifth scan and the homeward main scanning direction at the sixth scan, the intermission period T2=7 sec between the outward main scanning direction at the seventh scan and the homeward main scanning direction at the eighth scan, the intermission period T2=7 sec between the outward main scanning direction at the ninth scan and the homeward main scanning direction at the tenth scan, 0.2 sec required for the homeward main scanning at the sixth scan, 0.2 sec required for the outward main scanning at the seventh scan, 0.2 sec required for the homeward main scanning at the eighth scan, 0.2 sec required for the outward main scanning at the ninth scan, and 0.2 sec required for the homeward main scanning at the tenth scan.

In this case, the period T becomes 14.6 sec, which is the predetermined period T1 (=7.6 sec) or more, so the flow proceeds to Step S1015, where the recording medium P is discharged.

As described above, according to the third example, with the main scanning direction, the width X1 in the main scanning direction of the image region of which the recording width in the main scanning direction is the shortest of all of the image regions to be recorded on the recording surface of the recording medium P becomes 4 inches in the case of FIG. 15.

FIG. 15 illustrates the multiple image regions A through D divided in the sub scanning direction. These image regions A trough D correspond to an image region W1. The image regions A through D are regions recorded by scanning the recording head 402 once. The paper discharge roller 404, which conveys the recording medium P while coming into contact with the recording surface of the recording medium P, is disposed on the side closer to the paper discharging side than the recording head 402. The width between the ink discharge orifice closest to the paper discharging side of the ink discharge orifices employed for recording of the image regions A through D, and the paper discharge roller 404 becomes $^{256}/_{1200}$ (inch)×3 (number of scanning), i.e., $^{768}/_{1200}$ (inch). The width Y1 obtained by subtracting $^{256}/_{1200}$ (inch) serving as the width of the ink discharge orifice employed for recording from that width, $^{768}/_{1200}$ (inch) becomes $^{512}/_{1200}$ (inch).

An image region W2 defined by the width X1 and the width Y1 becomes the same size as an image region obtained by combining two of the image region A and the image region B of the third example.

Thus, the period T1 necessary for completing the image region W2 obtained by combining two of the image region A and the image region B with the third example becomes 7.6 sec obtained by aggregating 0.2 sec required for the homeward main scanning at the first scan, the intermission period T2=7 sec between the outward main scanning direction at the first scan and the homeward main scanning direction at the second scan, 0.2 sec required for the homeward main scanning at the second scan, and 0.2 sec required for the homeward main scanning at the third scan.

The period necessary for coming into contact with the paper discharge roller (auxiliary roller 404) from the image region to be recorded on the recording surface of the recording medium P having been completed with the third example is after the elapsing of 29.4 sec regarding the image regions A and B, after the elapsing of 22 sec regarding the image region C, and after the elapsing of 14.6 sec regarding the image region D. Thus, all of the image regions A through D result in coming into contact with the paper discharge roller 404 after the elapsing of the predetermined period T1 (=7.6 sec) or more. That is to say, as can be understood from the table in FIG. 17, even in a case wherein poor fixing of ink to the recording medium P, a recording image and the paper discharge roller 404 can be prevented from contamination.

The main scanning of the recording head 402 and conveyance of the recording medium are performed as to a region including no recording data closer to the paper discharging side than the image region with the third example for (1/3)×T1, i.e., around 2.6 sec or more from completion of the image region D up to the elapsing of 14.6 sec. Actions of the main scanning of the recording head 402 performed at this time will be described with reference to FIG. 7. As shown in FIG. 7, the twice-main scanning at the ninth scan and the tenth scan is performed, and following the main scanning at the tenth scan, the sub scanning for scanning the recording medium P is performed. Thus, the user can be informed that recording actions have not been completed as to the regions having no recording data closer to the paper supplying side than the image regions by performing the main scanning without recording, and the sub scanning for conveying the recording medium after completion of recording of the image regions.

In addition, providing an intermission period between the seventh main scanning and the eighth main scanning, which complete the image region D, and between the ninth main scanning and the tenth main scanning can yield a sufficient period from completion of the image region D. This period becomes a period of (1/3)×T1, i.e., around 14.6 sec or more. Also, as can be understood from the table in FIG. 17, even in the event that fixing of ink to the recording medium P is poor, contamination of recording images and the paper discharge roller 404 can be prevented by performing the same recording actions as the recording actions for completing the image regions A through D.

In addition, employing the paper discharge roller 404 having appropriate conveyance precision in the sub scanning direction of the recording medium P can improve the image quality of the recording image on the recording medium P.

Thus, a period from completion of recording of each image region up to passing through the paper discharge roller 404 can be set for each scanning by performing dot counting in an image region, so that a recording period can be reduced as compared with the first example.

Note that with the third example, setting of the dot count levels has been performed for each same recording medium, but the present invention is not restricted to this, so setting of the dot count levels may be performed for each main scanning, which can yield the same advantages as with the third example.

Also, with the third example, dot counting has been performed with the printer driver within the host computer, but the present invention is not restricted to this, so dot counting may be performed with the ink-jet recording apparatus main unit, which can yield the same advantages as with the third example.

Fourth Example

With a fourth example, description will be made regarding a case of canceling recording actions. With the fourth example, description will be made regarding a case wherein an image shown in FIG. 6 is recorded using the same recording head 402 as with the first example as an example.

Recording actions of the fourth example are the same recording actions as the first example, wherein simplex recording is performed by completing each image region in the outward main scanning direction, and providing an intermission period between the outward main scanning and the homeward main scanning.

Figure 24:
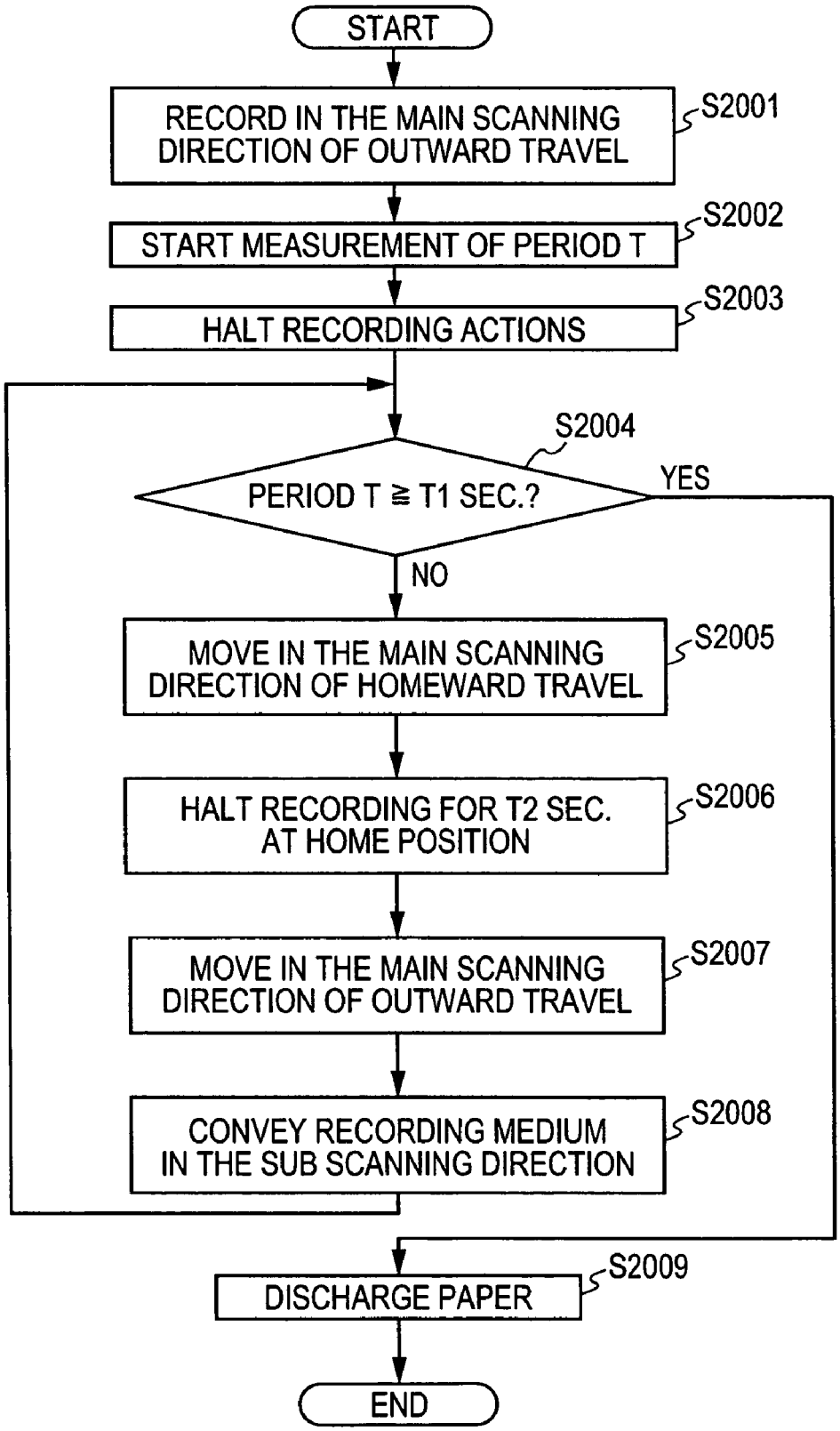
FIG. 24 is a flowchart illustrating recording actions with a fourth example of the present invention.

Description will be made below regarding recording actions of the fourth example with reference to FIG. 24. FIG. 24 is a flowchart illustrating recording actions of an ink-jet recording apparatus according to the fourth example of the present invention.

Note that the processing in FIG. 24 illustrates a case wherein cancel of recording actions is performed following Step S1005 of recording by Steps S1003 through S1009 in FIG. 10 according to the first example. Canceling of recording actions is performed in a case wherein a command for cancel of recording actions is received from the host computer, or in a case wherein a fault (out of ink, out of paper, paper jam, etc.) occurs at the ink-jet recording apparatus.

In Step S2001, recording of the image region A is performed at the first scan in FIG. 7 while moving the recording head 402 in the outward main scanning direction. In Step S2002, measurement of the period T from completion of recording is started.

In Step S2003, recording actions are canceled. In Step S2004, determination is made regarding whether or not the period T is the predetermined period T1 (=10.6 sec) or more.

Up to now, the period T has been measured as 10.2 sec obtained by aggregating the intermission period T2=10 sec between the outward main scanning at the first scan and the homeward main scanning at the second scan, and 0.2 sec required for the homeward main scanning at the second scan, and this is less than the predetermined period T=10.6 sec, so the flow proceeds to Step S2005.

In Step S2005, the recording head 402 is moved in the homeward main scanning direction at the second scan. In Step S2006, recording is halted at the home position h for the predetermined period T2=10 sec as an intermission period.

In Step S2007, following the halt, the recording head 402 is moved in the outward main scanning direction at the third scan. In Step S2008, on the counter home position side, the recording medium P is conveyed by a predetermined amount ($^{256}/_{1200}$ inch in this case) in the sub scanning direction by the paper feed roller 403 and the paper discharge roller 404.

Next, in Step S2004, determination is made regarding whether or not the period T is the predetermined period T1 (=10.6 sec) or more again.

Up to now, the period T has been measured as 10.4 sec obtained by aggregating 0.2 sec required for the homeward main scanning at the second scan, the intermission period T2=10 sec between the homeward main scanning at the second scan and the outward main scanning at the third scan, and 0.2 sec required for the outward main scanning at the third scan. This aggregation period is less than the predetermined period T1=10.6 sec, so similarly, the flow proceeds to Step S2008 from Step S2005.

Further, in Step S2004, determination is made regarding whether or not the period T is the predetermined period T1 (=10.6 sec) or more again.

Up to now, the period T has been measured as 20.8 sec obtained by aggregating 0.2 sec required for the homeward main scanning at the fourth scan, the intermission period T2=10 sec between the homeward main scanning at the fourth scan and the outward main scanning at the fifth scan, and 0.2 sec required for the outward main scanning at the fifth scan. This aggregation period is the predetermined period T1=10.6 sec or more, so the flow proceeds to Step S2009, where the recording medium P is discharged.

As described above, according to the fourth example, the period T has elapsed 20.8 sec from completion of recording of the image region A, so the recording medium P passes through the paper discharge roller 404 after the elapsing of the predetermined period T1=10.6. Accordingly, as can be understood from the table in FIG. 9 according to the first example, contamination caused by the recording medium P passing through the paper discharge roller 404 wherein ink is adhered to the paper discharge roller 404, and further, ink is transferred from the paper discharge roller 404 to the recording medium P, can be prevented.

Also, even in the case wherein cancel of recording actions is performed, as with the first example, an image region defined by the width X1 and the width Y1 becomes the same size as an image region obtained by combining two of the image region A and the image region B, and accordingly, the period T1 necessary for completing this image region becomes 10.6 sec.

The period necessary for coming into contact with the paper discharge roller 404 from the image region A to be recorded on the recording surface of the recording medium P having completed according to the fourth example is after the elapsing of 20.8 sec. Thus, the image region A results in coming into contact with the paper discharge roller 404 after the elapsing of the predetermined period T1 (=10.6 sec) or more. Accordingly, as can be understood from the table in FIG. 9, even in a case wherein poor fixing of ink to the recording medium P, a recording image and the paper discharge roller 404 can be prevented from contamination.

Also, with the fourth example, in the event that recording actions are cancelled before all recording data to be recorded on the same recording medium is completed, the scanning of the recording head 402 and conveyance of the recording medium P are performed until the elapsing of a predetermined period. This predetermined period is a period passed (1/3)×T1, i.e., around 3.5 sec or more from completion of the image region A up to the elapsing of 20.8 sec. Description will be made below regarding actions until the predetermined period elapses with reference to FIG. 7. Following recording actions being cancelled, 4-times main scanning of the second scan through the fifth scan is performed, and conveyance of the recording medium is performed between the third scan and the fourth scan, and between the fourth scan and the fifth scan. Thus, the user can be informed that recording actions have not been completed as to the regions having no recording data closer to the paper supplying side than the image regions by performing such actions.

In addition, providing an intermission period between the second main scanning and the third main scanning following recording actions being cancelled, and between the fourth main scanning and the fifth main scanning can satisfy 20.8 sec of (1/3)×T1, i.e., around 3.5 sec or more from completion of the image region D. Thus, even in the event of canceling recording actions, as can be understood from the table in FIG. 9, even in the event that fixing of ink to the recording medium P is poor, contamination of recording images and the paper discharge roller 404 caused by the recording surface of the recording medium P rubbing against the paper discharge roller 404 can be prevented.

In addition, employing the paper discharge roller 404 having appropriate conveyance precision in the sub scanning direction of the recording medium P can improve the image quality of the recording image on the recording medium P.

Note that with the fourth example, description has been made regarding the case wherein all of the image regions to be recorded on the recording surface of the recording medium P have 100% recording duty as an example. However, the present invention is not restricted to this configuration, and even if an image region has recording duty less than 100%, the same advantages can be obtained by performing the same recording actions.

Fifth Example

With a fifth example, description will be made regarding a case wherein there is no image data in the middle of image data to be recorded on the same recording medium.

Figure 25:
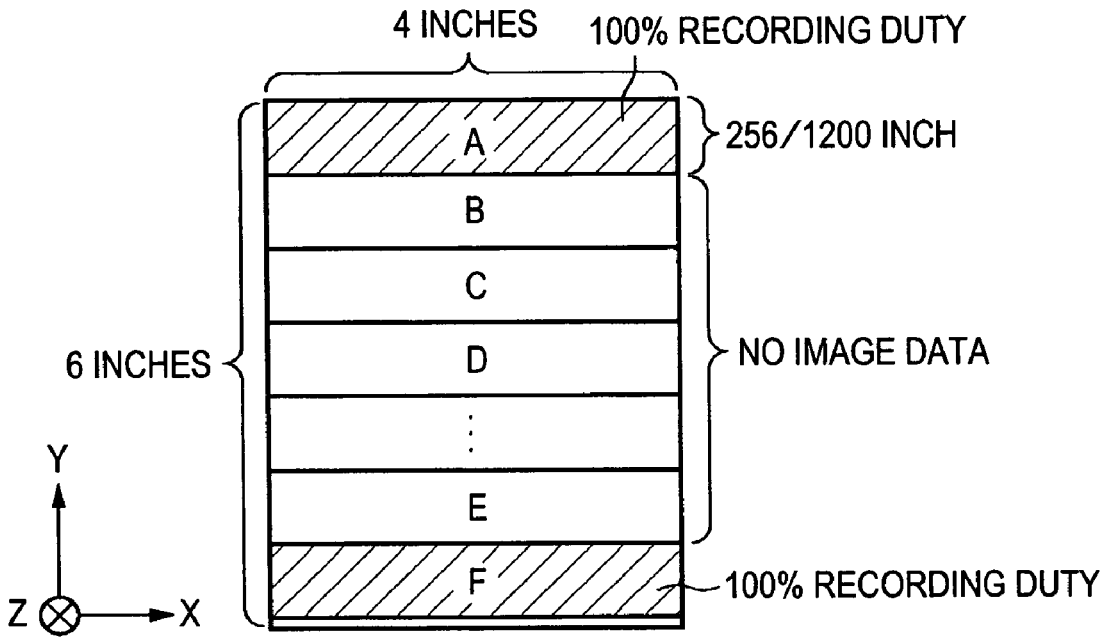
FIG. 25 is a diagram illustrating a recording image with a fifth example of the present invention.

With the fifth example, description will be made regarding a case wherein an image shown in FIG. 25 is recorded using the same recording head 402 as with the first example as an example.

Recording actions of the fifth example are the same recording actions as the first example, wherein simplex recording is performed by completing each image region in the outward main scanning direction, and providing an intermission period between the outward main scanning and the homeward main scanning.

First, description will be made regarding an example of a recording image according to the fifth example with reference to FIG. 25.

FIG. 25 is a diagram illustrating the recording image according to the fifth embodiment of the present invention.

In FIG. 25, for example, an example of glossy paper having a 4×6 inch size is illustrated as the recording medium P. Also, a recording image to be recorded on this recording medium P has a $^{256}/_{1200}$×4 inch size wherein recording duty of image regions A and F is 100%, and image regions B through E have no image data (null data).

Description will be made below regarding recording actions of the ink-jet recording apparatus of the fifth example with reference to FIG. 26.

Figure 26:
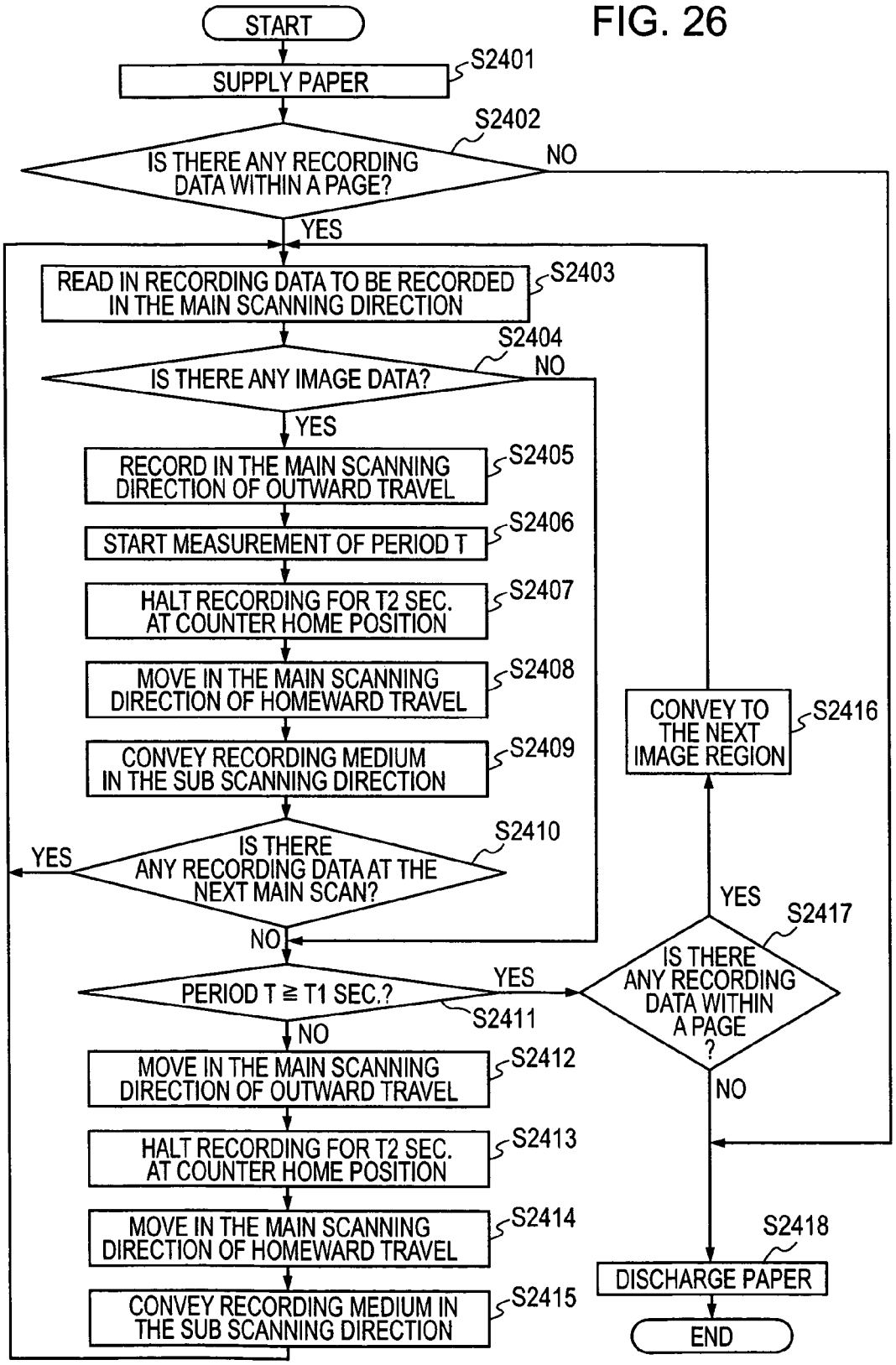
FIG. 26 is a flowchart illustrating recording actions with the fifth example of the present invention.

FIG. 26 is a flowchart illustrating recording actions of an ink-jet recording apparatus according to the fifth example of the present invention.

In FIG. 26, description will be made regarding a case of recording the image regions A through F shown in FIG. 25 as an example.

In Step S2401, paper feeding of the recording medium P is performed. In Step S2402, determination is made regarding whether or not recording data to be recorded exists within one page of the recording medium P. In the event of including no recording data (NO in Step S2402), the flow proceeds to Step S2418. On the other hand, in the event of including recording data (YES in Step S2402), the flow proceeds to Step S2403.

In this case, the recording data corresponding to the image regions A and F shown in FIG. 25 exists, so determination is made that there is recording data to be recorded within the page, and the flow proceeds to Step S2403.

In Step S2403, recording data to be recorded in the main scanning direction is read in. In this case, the recording data corresponding to the image region A is read in. In Step S2404, determination is made regarding whether or not image data to be processed exists. In the event of including no image data to be processed (NO in Step S2404), the flow proceeds to Step S2411. On the other hand, in the event of including image data to be processed (YES in Step S2404), the flow proceeds to Step S2405.

In this case, the recording data corresponding to the image region A exists, so determination is made that there is image data to be processed, and the flow proceeds to Step S2405.

In Step S2405, recording is performed while moving the recording head 402 in the outward main scanning direction. In the case of FIG. 25, recording of the image region A is performed at the first scan while moving the recording head 402 in the outward main scanning direction.

In Step S2406, measurement of the period T from completion of recording is started. In Step S2407, as an intermission period, recording is halted at the counter home position for the predetermined period T2 (10 sec in this case).

In Step S2408, following the halt, the recording head 402 is moved in the homeward main scanning direction. In Step S2409, upon the recording head 402 returning to the home position h side, the recording medium P is conveyed by a predetermined amount ($^{256}/_{1200}$ inch in this case) in the sub scanning direction by the paper feed roller 403 and the paper discharge roller 404.

Up to now, the period T has been measured as 10.2 sec obtained by aggregating the intermission period T2=10 sec between the outward main scanning direction at the first scan and the homeward main scanning direction at the second scan, and 0.2 sec required for the homeward main scanning at the second scan.

Next, in Step S2410, determination is made whether or not recording data to be recorded exists at the next main scanning. In the event of no recording data (NO in Step S2410), the flow proceeds to Step S2411. On the other hand, in the event that recording data exists (YES in Step S2410), the flow returns to Step S2403.

In this case, the image region B on the side closer to the paper discharging side than the image region A shown in FIG. 25 has no image data, so determination is made that no recording data to be recorded exists at the next main scanning, and the flow proceeds to Step S2411.

In Step S2411, determination is made regarding whether or not the period T is a predetermined period T1 (10.6 sec in this case) or more. In the event that the period T is the predetermined period T1 or more (YES in Step S2411), the flow proceeds to Step S2417. On the other hand, in the event that the period T is less than the predetermined period T1 (NO in Step S2411), the flow proceeds to Step S2412.

In this case, the period T from completion of the image region A is 10.2 sec, so is less than the predetermined period T1 (=10.6 sec), and the flow proceeds to Step S2412.

In Step S2412, the recording head 402 is moved in the outward main scanning direction. In the case of FIG. 25, the recording head 402 is moved in the outward main scanning direction at the third scan.

In Step S2413, recording is halted at the counter home position for the predetermined period T2 (=10 sec) as an intermission period. In Step S2414, following the halt, the recording head 402 is moved in the homeward main scanning direction. In the case of FIG. 25, the recording head 402 is moved in the homeward main scanning direction at the fourth scan.

In Step S2415, upon the recording head 402 returning to the home position h side, the recording medium P is conveyed by a predetermined amount ($^{256}/_{1200}$ inch in this case) in the sub scanning direction by the paper feed roller 403 and the paper discharge roller 404.

In Step S2403, recording data to be recorded in the main scanning direction is read in. In this case, the recording data corresponding to the image region B is read in. In Step S2404, determination is made regarding whether or not image data to be processed exists.

In this case, the recording data corresponding to the image region B does not exist, so determination is made that there is no image data to be processed, and the flow proceeds to Step S2411.

Up to now, the period T is measured as 20.6 sec obtained by aggregating 0.2 sec required for the homeward main scanning at the second scan, the intermission period T2=10 sec between the outward main scanning direction at the first scan and the homeward main scanning direction at the second scan, 0.2 sec required for the outward main scanning at the third scan, the intermission period T2=10 sec between the outward main scanning direction at the third scan and the homeward main scanning direction at the fourth scan, and 0.2 sec required for the homeward main scanning at the fourth scan.

Subsequently, with the determination in Step S2411, the period T is 20.6 sec, so is the predetermined period T1 (=10.6 sec) or more, and the flow proceeds to Step S2417.

In Step S2417, determination is made regarding whether or not recording data to be recorded exists within one page of the recording medium P. In the event of including no recording data (NO in Step S2417), the flow proceeds to Step S2418. On the other hand, in the event of including recording data (YES in Step S2417), the flow proceeds to Step S2416.

In this case, the recording data corresponding to the image region F shown in FIG. 25 exists, so determination is made that there is recording data to be recorded within the page, and the flow proceeds to Step S2416.

In Step S2416, as far as the image regions C through E are concerned, the recording medium P is conveyed by the amount of the respective image regions×a predetermined amount ($^{256}/_{1200}$ inch in this case) in the sub scanning direction by the paper feed roller 403 and the paper discharge roller 404.

In Step S2403, recording data to be recorded in the main scanning direction is read in. In this case, the recording data corresponding to the image region F is read in. In Step S2404, determination is made regarding whether or not image data to be processed exists.

In this case, the recording data corresponding to the image region F exists, so determination is made that there is image data to be processed, and the flow proceeds to Step S2405.

In Step S2405, recording is performed while moving the recording head 402 in the outward main scanning direction. In the case of FIG. 25, recording of the image region F is performed at the fifth scan while moving the recording head 402 in the outward main scanning direction.

In Step S2406, measurement of the period T from completion of recording is started. In this case, the period T is overwritten, measurement of the period T from completion of recording at the fifth scan is started. In Step S2407, as an intermission period, recording is halted at the counter home position for the predetermined period T2 (=10 sec).

In Step S2408, following the halt, the recording head 402 is moved in the homeward main scanning direction. In this case, the recording head 402 is moved in the homeward main scanning direction at the sixth scan.

In Step S2409, upon the recording head 402 returning to the home position h side, the recording medium P is conveyed by a predetermined amount (256/1200 inch) in the sub scanning direction by the paper feed roller 403 and the paper discharge roller 404.

Next, in Step S2410, determination is made whether or not recording data to be recorded exists at the next main scanning.

In this case, no image region exists on the side closer to the paper discharging side than the image region F shown in FIG. 25, i.e., no image data exists, so determination is made that no recording data to be recorded exists at the next main scanning, and the flow proceeds to Step S2411.

Up to now, the period T has been measured as 10.2 sec obtained by aggregating the intermission period T2=10 sec between the outward main scanning direction at the fifth scan and the homeward main scanning direction at the sixth scan, and 0.2 sec required for the homeward main scanning at the sixth scan.

In Step S2411, determination is made whether or not the period T is the predetermined period T1 (10.6 sec in this case) or more.

In this case, the period T is 10.2 sec, so is less than the predetermined period T1 (=10.6 sec), and the flow proceeds to Step S2412.

In Step S2412, the recording head 402 is moved in the outward main scanning direction. In this case, the recording head 402 is moved in the outward main scanning direction at the seventh scan.

In Step S2413, recording is halted at the counter home position for the predetermined period T2 (=10 sec) as an intermission period. In Step S2414, following the halt, the recording head 402 is moved in the homeward main scanning direction. In the case, the recording head 402 is moved in the homeward main scanning direction at the eighth scan.

In Step S2415, upon the recording head 402 returning to the home position h side, the recording medium P is conveyed by a predetermined amount (256/1200 inch in this case) in the sub scanning direction by the paper feed roller 403 and the paper discharge roller 404.

In Step S2403, recording data to be recorded in the main scanning direction is read in. In Step S2402, determination is made regarding whether or not image data to be processed exists.

In this case, no image region exists on the side closer to the paper discharging side than the image region F, so determination is made that there is no image data to be processed, and the flow proceeds to Step S2411.

Up to now, the period T is measured as 20.6 sec obtained by aggregating the intermission period 10 sec between the outward main scanning direction at the fifth scan and the homeward main scanning direction at the sixth scan, 0.2 sec required for the homeward main scanning at the sixth scan, 0.2 sec required for the outward main scanning at the seventh scan, the intermission period 10 sec between the outward main scanning direction at the seventh scan and the homeward main scanning direction at the eighth scan, and 0.2 sec required for the homeward main scanning at the eighth scan.

Subsequently, with the determination in Step S2411, the period T is 20.6 sec, so is the predetermined period T1 (=10.6 sec) or more, and the flow proceeds to Step S2417, where the recording medium P is discharged.

As described above, according to the fifth example, even in the event that there is no image data which indicates recording in the middle of image data to be recorded on the same recording medium, an image region W2 defined by the width X1 and the width Y1 becomes the same size as an image region obtained by combining two of the image region A and the image region B. Note that the case wherein there is no image data which indicates recording means that the region thereof is data indicating null. Also, the period T1 necessary for completing this image region obtained by combining two of the image region A and the image region B becomes 10.6 sec.

The period necessary for coming into contact with the paper discharge roller 404 from the image region A to be recorded on the recording surface of the recording medium P having been completed according to the fifth example is after the elapsing of 20.6 sec. Thus, the image region A results in coming into contact with the paper discharge roller 404 after the elapsing of the predetermined period T1=10.6 sec or more. Accordingly, as can be understood from the table in FIG. 9, even in a case wherein poor fixing of ink to the recording medium P, a recording image and the paper discharge roller 404 can be prevented from contamination.

Also, a region including no recording data on the side closer to the paper supplying side than the image regions according to the fifth example occurs in the event that there is a region on which recording is not performed in the middle of the image data to be recorded on the same recording medium, as with the fifth example. With the configuration in this fifth example, scanning of the recording head 402 and conveyance of the recording medium are performed for (1/3)×T1, i.e., around 3.5 sec or more from completion of the image region A up to the elapsing of 20.6 sec. Now, description will be made regarding actions to be performed with reference to FIG. 7. The main scanning for scanning the recording head 402 is performed four times, i.e., the first scan through the fourth scan. Also, the sub scanning for conveying the recording medium P is performed twice, i.e., between the first main scanning and the second main scanning, and between the third main scanning and the fourth main scanning. Thus, the user can be informed that recording actions have not been completed as to the regions having no recording data closer to the paper supplying side than the image regions by performing the main scanning and the sub scanning.

In addition, providing an intermission period between following the first main scanning which completes the image region A in FIG. 25 until start of the second main scanning, and between the third scan and the fourth scan. Thus configured, a sufficient elapsed period from completion of the image region A can be obtained. Accordingly, as can be understood from the table in FIG. 9, even in the event that fixing of ink to the recording medium P is poor, contamination of recording images and the paper discharge roller 404 can be prevented.

In addition, employing the paper discharge roller 404 having appropriate conveyance precision in the sub scanning direction of the recording medium P can improve the image quality of the recording image on the recording medium P.

Also, in the event that there is no recording data in a region closer to the paper supplying side than the imager region, following the elapsing of the period T1 or more passed from recording of the image region up to passing through the paper discharge roller 404, the recording medium is conveyed in the sub scanning direction just before the image region to be recorded next. Thus configured, an extra period can be reduced as compared with the first example.

Note that with the fifth example, description has been made regarding the case wherein all of the image regions to be recorded on the recording surface of the recording medium P have 100% recording duty as an example. However, the present invention is not restricted to this configuration, and even if an image region has recording duty less than 100%, the same advantages can be obtained by performing the same recording actions.

Sixth Example

With the first through fifth examples, description has been made regarding the case wherein the single recording head 402 composing ink discharge orifices arrayed in a row is provided as shown in FIG. 2, and discharges black ink. However, the present invention is not restricted to the configuration of such a recording head. For example, the present invention can be applied to even with a configuration employing a recording head comprising ink discharge orifices arrayed in multiple rows. With the configuration employing such a recording head, a period from completion of recording of each region up to passing through the paper discharge roller 404 is taken as a predetermined amount or more, thereby yielding the same advantages as with the first through fifth examples.

Also, with the first example through the fifth example, description has been made using ink droplets of around 4 pl, but the present invention is not restricted to this. The present invention can be applied to a configuration wherein ink droplets greater than around 4 pl are discharged, or a configuration wherein ink droplets smaller than around 4 pl. Also, the present invention can be further applied to even a configuration wherein recording heads of which the size of ink droplets differs for each color or for each nozzle are employed.

Also, with the first example, the fourth example, and the fifth example, description has been made regarding the case wherein both the same main scanning and the same sub scanning as those in recording actions are performed for elapse of the period T1. Also, with the second example, description has been made regarding the case wherein only the sub scanning different from recording actions is repeated. However, the present invention is not restricted to the above configurations. For example, a configuration wherein the main scanning alone is repeated for elapse of the period T1 may be employed. Also, an arrangement may be made wherein only the sub scanning identical with recording actions is repeated, and further, only the main scanning different from recording actions is repeated.

Also, with the above respective examples, a period from completion of recording of each image region up to passing through the paper discharge roller 404 has been set uniformly. However, the present invention is not restricted to this configuration. For example, a period from completion of recording of each image region up to passing through the paper discharge roller 404 may be set differently. Examples of the triggers varying this period include the type of recording medium, the size of a recording medium, the amount of ink discharged from the recording head 402, and the amount of data per one pixel. Also, examples of the other triggers varying this period include at least one of, an image region to be recorded, the distance from the ink discharge orifice closest to the paper discharging side to the paper discharge roller 404, and the recording mode. In addition, these triggers are arbitrarily combined, and a period from completion of recording of each image region up to passing through the paper discharge roller 404 may be changed according to conditions.

Also, with the first example through the fifth example, description has been made assuming that of the ink-jet discharge orifices employed for recording of the image region W1, the width Y1 obtained by subtracting the width of the ink-jet discharge orifice employed for recording from the width between the ink discharge orifice closest to the paper discharging side and the paper discharge roller 404 is $^{512}/_{1200}$ inch. However, the present invention is not restricted to a configuration wherein the width Y1 is $^{512}/_{1200}$ inch. For example, the width Y1 may be set longer or shorter than $^{512}/_{1200}$ inch.

Also, with the above respective examples, description has been made regarding the case wherein the predetermined period T1 from completion of recording of each image region up to passing through the paper discharge roller 404 is made uniform. However, the present invention is not restricted to this configuration. That is to say, the period T1 may be set differently in order to improve throughput. For example, as shown in FIG. 27, the period T3 ($T3 \geqq (1/3) \times T1$) from completion of all the image regions to be recorded on the recording surface of the recording medium P up to passing through the paper discharge roller 404 may be set to 7.6 sec, which is different from the period T1. This period 7.6 sec, as shown in the table of FIG. 9, is a period wherein the items regarding contamination of the paper discharge roller 404, and transfer to the recording medium is in the "triangle" state. That is to say, this indicates a state wherein even though the paper discharge roller 404 is contaminated, contamination is not transferred to the recording surface of the recording medium P from the paper discharge roller 404.

Figure 28:
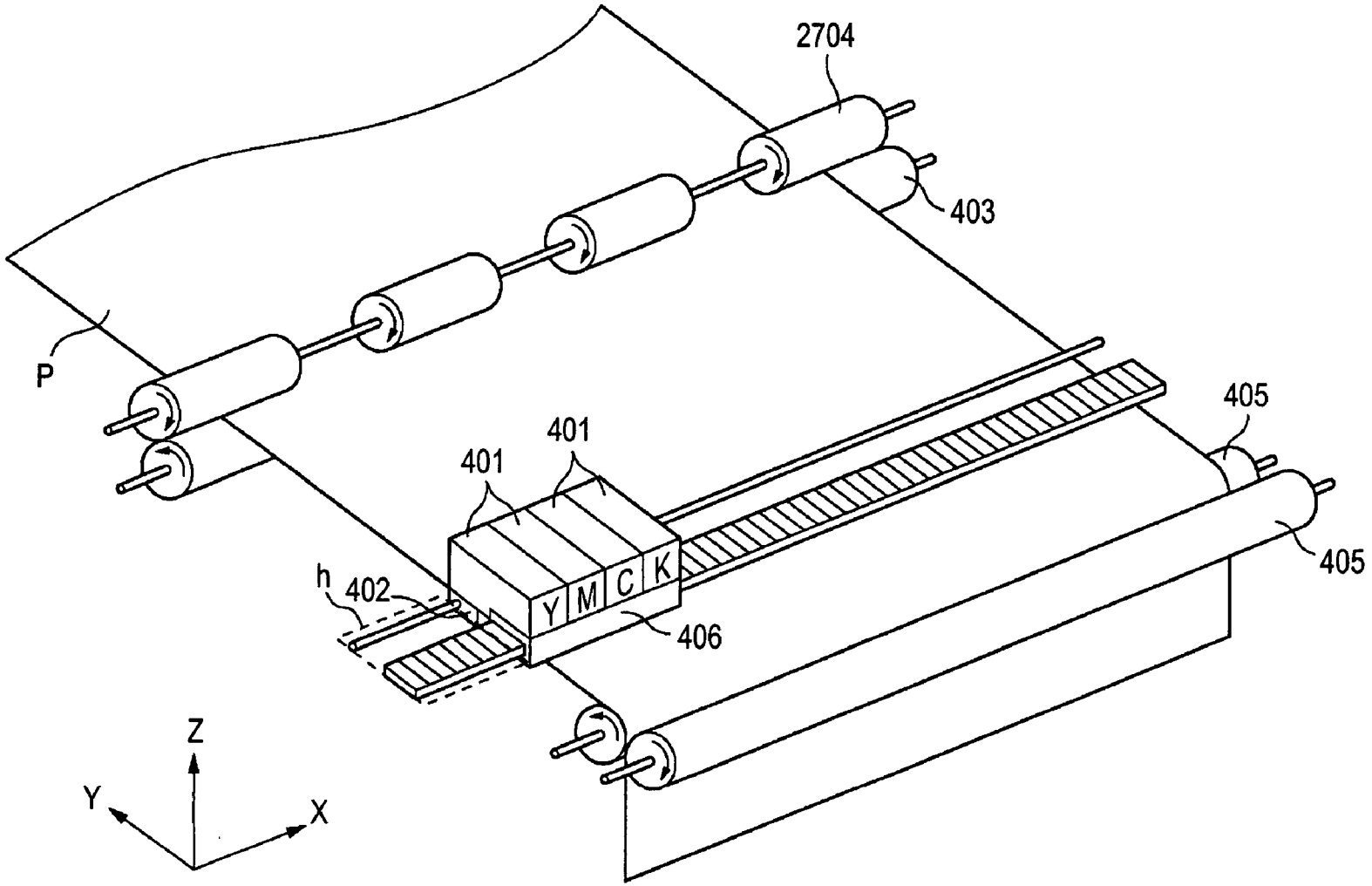
FIG. 28 is a diagram illustrating the schematic configuration of an ink-jet recording apparatus to which the sixth example of the present invention can be applied.

Also, with the above respective examples, description has been made with the paper discharge roller 404 made up of a single roller, as shown in FIG. 4. However, with the present invention, the paper discharge roller may be configured differently. For example, as a paper discharge roller 2704 shown in FIG. 28, the paper discharge roller may be configured with multiple rollers divided into a predetermined width. FIG. 28 illustrates the paper discharge roller 2704 made up of four rollers.

Figure 29:
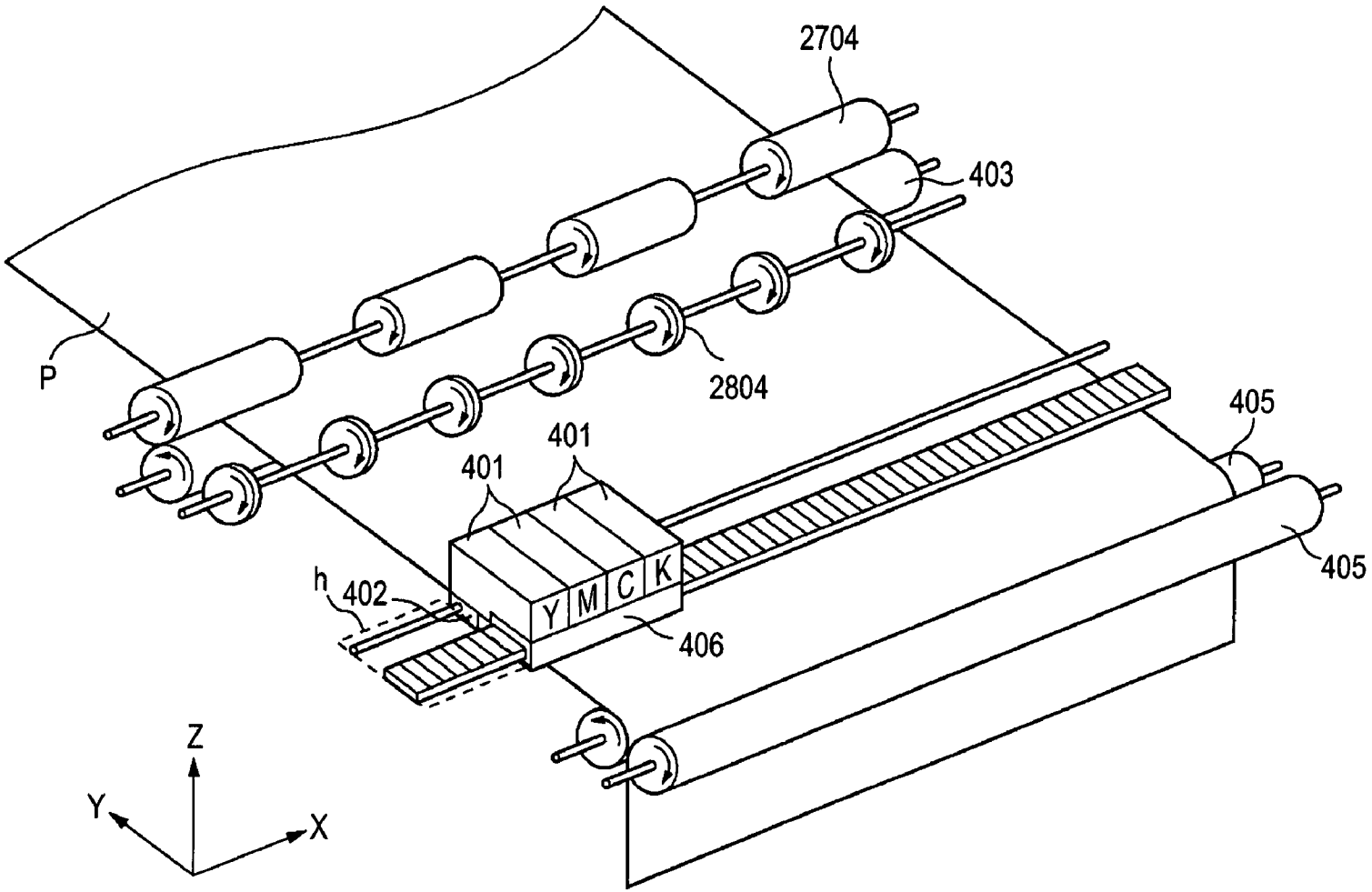
FIG. 29 is a diagram illustrating the schematic configuration of an ink-jet recording apparatus to which the sixth example of the present invention can be applied.

Also, another configuration of the paper discharge roller to which the present invention can be applied is illustrated in FIG. 29. The configuration in FIG. 29 illustrates an example wherein an auxiliary roller 2804 is provided for improving conveyance precision of the recording medium P in addition to the configuration shown in FIG. 28. Also, as well as the configuration in FIG. 29, a configuration may be made wherein rollers arrayed in two rows are provided in the sub scanning direction.

As described above, the present invention is for setting a period passed from recording of each image region up to passing through the paper discharge roller. According to the present invention, a sufficient period is secured for ink permeating and fixing to the recording medium. Accordingly, a state wherein the recording medium P passes through the paper discharge roller before ink is fixed to the recording medium, the ink is adhered to the paper discharge roller, and further, the ink is transferred to the recording medium P from the paper discharge roller, can be prevented. In addition, employing a paper discharge roller having appropriate conveyance precision in the sub scanning direction of the recording medium P can improve the image quality of a recording image to be recorded on the recording medium.

Note that with the above examples, description has been made assuming that a droplet to be discharged from the recording head is ink, and further, description has been made assuming that liquid accommodated in the ink tank is ink, but the accommodated object is not restricted to ink. For example, an object such as processing liquid to be discharged as to the recording medium for improving fixation and water resistance of a recording image, and for improving the image quality thereof may be accommodated in the ink tank.

As for an arrangement of the recording apparatus to which the present invention can be applied, an article which can be provided integrally or separately as an image output terminal of information processing equipment such as a computer or the like, can be quoted. Also, as for another arrangement, a copying apparatus combined with a reader or the like, and further, an arrangement of a facsimile apparatus having transmission/reception functions can be quoted.

As described above, the examples have been described in detail, but the present invention can be taken as an embodiment, for example, such as a system, apparatus, method, program, recording medium, and so forth. Specifically, the present invention may be applied to a system made up of a plurality of pieces of equipment, or may be applied to an apparatus made up of a single piece of equipment.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2004-290385 filed Oct. 1, 2004, which is hereby incorporated by reference herein in its entirety.

What is claimed is:

1. A recording apparatus for recording an image on a recording medium, the recording being performed with a main scanning operation for scanning a recording head for discharging ink in a main scanning direction and by a sub scanning operation for sub scanning the recording medium in a sub scanning direction by using a roller provided downstream of the recording head in the sub scanning direction that is different from the main scanning direction, the recording apparatus comprising:

a control unit that controls both the main scanning operation and the sub scanning operation such that a time period from a time when recording of a predetermined area of the recording medium is completed until a time when the predetermined area contacts the roller is longer than a predetermined time, wherein the control unit executes, in a case where, after an image to be recorded is recorded in the predetermined area within a page of the recording medium, recording data corresponding to the image to be recorded does not exist within the page of the recording medium, repeating the main scanning operation and the sub scanning operation, which do not accompany the recording of an image on the recording medium during the time period from the time when the recording of the predetermined area within the page of the recording medium is completed until the time when the predetermined area contacts the roller, such that the time period until the time when the predetermined area contacts the roller is longer than the predetermined time, and discharges the recording medium without the main scanning operation after the predetermined area contacts the roller.

2. The recording apparatus according to claim 1, wherein the case where there is no recording data is a state in which recording of all image data to be recorded on a same recording medium is completed.

3. The recording apparatus according to claim 1, wherein the case where there is no recording data is a state in which a recording operation is canceled before the recording of all image data to be recorded on the same recording medium is completed.

4. The recording apparatus according to claim 1, wherein the case where there is no recording data is a state in which there is no image data in a middle of image data to be recorded on the same recording medium.

5. The recording apparatus according to claim 1, further comprising a calculation unit configured to calculate a number of recording dots in the respective predetermined area, wherein the control unit differentiates the predetermined time in accordance with the number of the recording dots in the predetermined area.

6. The recording apparatus according to claim 1, wherein the control unit differentiates the predetermined time in accordance with at least one of, or an arbitrary combination of a type of recording medium, a size of a recording medium, an amount of ink discharged from the recording head and an amount of data per one pixel.

7. The recording apparatus according to claim 1, wherein the control unit differentiates the intermission period in accordance with either one of a number of the main scanning operations to complete the recording of the predetermined area, a scanning speed of the recording head in the main scanning operation, and a scanning speed of the recording medium in the sub scanning operation.

8. The recording apparatus according to claim 1, wherein the control unit provides the intermission period in which the main scanning operation is halted during the sub scanning operation in the case where there is no recording data and executes the main scanning operation and the sub scanning operation.

* * * * *